US005474884A

United States Patent [19]

Okazaki

[11] Patent Number: 5,474,884

[45] Date of Patent: Dec. 12, 1995

[54] SILVER HALIDE COLOR PHOTOGRAPHIC MATERIAL AND METHOD FOR FORMING AN IMAGE

[75] Inventor: Kentaro Okazaki, Minami-ashigara, Japan

[73] Assignee: Fuji Photo Film Co., Ltd., Kanagawa, Japan

[21] Appl. No.: 432,932

[22] Filed: May 1, 1995

Related U.S. Application Data

[63] Continuation of Ser. No. 159,253, Nov. 30, 1993, abandoned.

[30] Foreign Application Priority Data

Nov. 30, 1992 [JP] Japan ..... 4-343424

[51] Int. Cl.[6] ..... G03C 1/775; G03C 1/34

[52] U.S. Cl. ..... 430/533; 430/551; 430/556; 430/557

[58] Field of Search ..... 430/533, 551, 430/556, 557

[56] References Cited

U.S. PATENT DOCUMENTS

| | | | |
|---|---|---|---|
| 4,732,845 | 3/1988 | Keiji et al. | 430/551 |
| 4,980,274 | 12/1990 | Tai et al. | 430/533 |
| 5,270,158 | 12/1993 | Nakatsugawa et al. | 430/551 |
| 5,273,867 | 12/1993 | Shibuya et al. | 430/551 |
| 5,288,599 | 2/1994 | Takahashi et al. | 430/551 |

FOREIGN PATENT DOCUMENTS

| | | |
|---|---|---|
| 69070 | 1/1983 | European Pat. Off. . |
| 98072 | 1/1984 | European Pat. Off. . |
| 507489 | 10/1992 | European Pat. Off. . |

*Primary Examiner*—Janet C. Baxter
*Attorney, Agent, or Firm*—Sughrue, Mion, Zinn, Macpeak & Seas

[57] ABSTRACT

There is disclosed a silver halide color photographic material and a method for forming an image using the same. The silver halide color photographic material has a yellow-coupler-, a magenta-coupler-, and a cyan-coupler-containing silver halide emulsion layer, which respective layers are different in color sensitivity from each other, and non-photosensitive hydrophilic colloid layers, on a reflective support; and comprises (i) a reflective support prepared by covering at least the surface to be emulsion-coated of the support with a composition prepared by mixing and dispersing a white pigment into a water-resistant resin whose major component is a polyester obtained by polycondensation of a dicarboxylic acid and a diol, (ii) a silver halide emulsion of at least one emulsion layer comprising silver halide grains having a silver chloride content of 90 mol % or more, (iii) at least one non-photosensitive layer containing at least one color-mix inhibitor having a molecular weight of 350 or more, and (iv) a yellow coupler having a relative coupling rate of 0.20 or over.

16 Claims, No Drawings

SILVER HALIDE COLOR PHOTOGRAPHIC MATERIAL AND METHOD FOR FORMING AN IMAGE

This is a Continuation of application Ser. No. 08/159,253 filed Nov. 30, 1993, now abandoned.

FIELD OF THE INVENTION

The present invention relates to a silver halide color photographic material that can be processed rapidly, and a method for forming a color image utilizing the photographic material. When the silver halide photographic material in product form is stored for a long period of time, the silver halide color photographic material has excellent sharpness and good gloss, and its change in density due to a change in duration from the moment of exposure to light until the development processing is small.

BACKGROUND OF THE INVENTION

In recent years, in this industry, silver halide photographic material that can be processed rapidly and high in image quality have been desired.

In the development processing of silver halide photographic materials, generally, such materials are continuously processed by an automatic processor installed in a photofinishing laboratory. And, as a part of service to users, it is demanded that the silver halide photographic material be subjected to development processing and returned to the user on the day the material is received. Further, currently it is even demanded that such material be returned to the user within one hour after its receipt, which means that the need for rapid processing is being heightened increasingly. Further, since shortening of the processing time improves the production efficiency and enables the cost to be reduced, the development of rapid processing is urgently required.

Under these circumstances, it is known that the shape, size, and composition of silver halide grains in silver halide emulsions used in photographic materials influence greatly, for example, the rate of development. It is also known that the influence of the halogen composition is great, and a noticeably high rate of development is exhibited particularly when a silver halide high in silver chloride content is used.

Further, in recent years, in view of the protecting the environment and the reducing the burden of labor for the preparation of color developers, it is desired that the color developer be free from benzyl alcohol. Further, although sulfites, which are used as an antioxidant, for example, for the developing agent in a color developer, react with the oxidized product of the color developing agent, they also react with couplers competitively, thereby lowering the density of the image. Therefore, it is also desired that sulfites not be contained in a color developer because, for example, when the amount of the sulfite in a color developer changes, the density of the color-formed dye changes accordingly.

Taking the above conditions into consideration, lately, a method for processing using a color developer substantially free from benzyl alcohol and sulfites by using a silver halide high in silver chloride content has been put into practice, as disclosed, for example, in International Patent WO No. 87-04534.

On the other hand, with respect to the image quality, further improvement in sharpness is expected, for example, in order to make the fullest use of the function of color negative film or to meet various exposure systems resulting from enlarged applications of color prints. Particularly in the latter, in recent years, high sharpness is demanded for the purpose of reproducing, in addition to common photographic images, images that require high contrast in narrow areas, such as figures, characters, and letters.

In order to increase the sharpness of images, water-soluble dyes are generally used in color photographic materials. This is described, for example, in JP-A ("JP-A" means unexamined published Japanese patent application) No. 283336/1987, and in *Research Disclosure* (RD) Nos. 17643 (page 22, December 1978) and 18716 (page 647, November 1979).

A method for increasing the sharpness of images is described in JP-A No. 286849/1988 wherein the optical reflection density is brought to a certain density or over when a colorant, such as an antihalation layer (AH), is used that comprises a water-soluble dye, colloidal silver, or a dispersion of a solid dye, which colorant can be decolored with development processing.

If the amount of such a water-soluble dye or the number of antihalation layers to be used for increasing the sharpness of images is increased excessively, the rapid processing mentioned above brings about an increase of the remaining amount of the dye and the like after the processing, thereby lowering the whiteness, which is a serious problem, and therefore there is a limit to the usable amount of the dye.

As another method for increasing the sharpness of images, a method is known wherein the optical reflectance in the vicinity of the surface of a support is increased. For example, JP-B ("JP-B" means examined Japanese patent publication) No. 53937/1982 and U.S. Pat. No. 4,558,002 disclose methods wherein a hydrophilic colloid layer containing a white pigment in a high-filling amount is placed between a polyolefin-covered support and a photographic emulsion layer. However, these methods are accompanied by a significant defect in that the drying rate drops because the overall thickness of the hydrophilic colloid layers increases, and therefore these methods are not desirable.

Methods for increasing the content of a white pigment to be filled in a water-resistant resin are described, for example, in U.S. Pat. No. 5,151,345 and JP-A No. 156452/1991. Methods for incorporating a large amount of a white pigment in a water-resistant resin do not result in the harmful effect of the above-mentioned methods that provide a hydrophilic colloid layer. However, in a generally used polyolefin water-resistant resin, when the content of a white pigment is increased, a problem arises that the smoothness and the surface gloss decrease. Therefore, there is need for development of a method for increasing the content of a white pigment in a water-resistant resin without deteriorating these performances.

EP-057489A describes a method wherein a polyester is used as a water-resistant resin, disclosing that the smoothness and surface gloss are high. However, the present inventors have prepared, in accordance with EP-0507489A, a support, on which in turn photographic constitutional layers are applied, and they have investigated the photographic performance. As a result, the inventors have found that, although the smoothness and gloss are high, there is a defect in that the change in density due to a change in duration from the moment of exposure to light until the development processing, is apt to increase if the photographic material, in the form of a product prepared by applying photographic constitutional layers, is stored for a long period of time. When this happens, the work of so-called test printing by which exposure conditions, such as exposure time and filter balance, are determined, is seriously hindered, such that productivity can be lowered.

SUMMARY OF THE INVENTION

Therefore, the object of the present invention is to provide a silver halide color photographic material that can be processed rapidly, it has excellent sharpness and good gloss, and its change in density due to a change in duration from the moment of exposure to light until the development processing is small, even after the silver halide photographic material in product form is stored for a long period of time; and also to provide a method for forming an image on the said material.

The above and other objects, features, an advantages of the invention will become fully apparent in the following description.

DETAILED DESCRIPTION OF THE INVENTION

The present inventors, having studied keenly to solve the above problems in various ways, surprisingly found that, when a polyester is used as a water-resistant resin, the change in density due to a change in duration from the moment of exposure to light until the development processing, can be made small by using a color-mix inhibitor of the present invention and a yellow coupler of the present invention, leading to the present invention. Accordingly, the object of the present invention can be realized by the following means:

(1) A silver halide color photographic material having a yellow-coupler-containing silver halide emulsion layer, a magenta-coupler-containing silver halide emulsion layer, and a cyan-coupler-containing silver halide emulsion layer, which respective layers are different in color sensitivity from each other, and non-photosensitive hydrophilic colloid layers, on a reflective support; which comprises (i) a reflective support prepared by covering at least the surface to be emulsion-coated of the support with a composition prepared by mixing and dispersing a white pigment into a water-resistant resin whose major component is a polyester obtained by polycondensation of a dicarboxylic acid and a diol, (ii) a silver halide emulsion of at least one emulsion layer comprising silver halide grains having a silver chloride content of 90 mol % or more, (iii) at least one non-photosensitive layer containing at least one color-mix inhibitor having a molecular weight of 350 or more, and (iv) a yellow coupler having a relative coupling rate of 0.20 or over.

(2) A silver halide color photographic material as stated in (1) above, wherein the polyester on the reflective support is a polyester whose major component is a polyethylene terephthalate.

(3) A silver halide color photographic material as stated in (1) above, wherein the reflective support is prepared by covering at least the surface to be emulsion-coated of the support with a resin composition obtained by mixing and dispersing a white pigment into a polyester synthesized by polycondensation of mixed dicarboxylic acids of terephthalic acid and isophthalic acid (in a molar ratio of from 9/1 to 2/8) and a diol.

(4) A silver halide color photographic material as stated in (1) above, wherein the reflective support is prepared by covering at least the surface to be emulsion-coated of the support with a resin composition obtained by mixing and dispersing a white pigment into a polyester synthesized by polycondensation of mixed dicarboxylic acids of terephthalic acid and naphthalenedicarboxylic acid (in a molar ratio of from 9/1 to 2/8) and a diol.

(5) A silver halide color photographic material as stated in (1) above, wherein the diol is ethylene glycol.

(6) A silver halide color photographic material as stated in (1) above, wherein the white pigment on the reflective support is titanium dioxide, and the weight ratio of the white pigment to the resin that is mixed with said white pigment, which resin's major component is a polyester, is from 5/95 to 70/30.

(7) A silver halide color photographic material as stated in (1) above, wherein the color-mix inhibitor having a molecular weight of 350 or more is represented by the following formula (I):

formula (I)

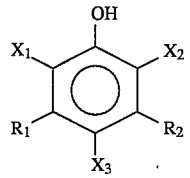

wherein $X_1$, $X_2$, $X_3$, R1, and $R_2$ each represent a hydrogen atom or a substituent, and at least one of $X_1$, $X_2$, and $X_3$ represents a hydroxyl group or a sulfonamido group, provided that $X_1$, $X_2$, $X_3$, $R_1$, and $R_2$ are selected such that the molecular weight of the compound is 350 or more, the substituents in the ortho-positions relative to each other may bond together to form a ring, and any of $X_1$, $X_2$, $X_3$, $R_1$, and $R_2$ may be bonded to a polymer chain or may be bonded to a compound represented by formula (I), to form a dimer or a higher polymer.

(8) A method for forming a color image, which comprises exposing a color photographic material as stated in (1) above to light in a scanning exposure method with the exposure time being $10^{-4}$ sec or less per picture element, and then color-development processing said exposed color photographic material.

The present invention will now be described in more detail below.

In the specification and claims of the present invention, the term "major component" means that the content of the major component is 50 wt % or more.

It is necessary that the reflective support in the present invention is covered on the surface of a base paper on the surface side to be emulsion-coated, with a composition containing a white pigment mixed and dispersed into a resin whose major component is a polyester.

This polyester is one synthesized by condensation polymerization of a dicarboxylic acid and a diol. As preferable dicarboxylic acids, for example, terephthalic acid, isophthalic acid, and naphthalenedicarboxylic acid can be mentioned. As preferable diols, for example, ethylene glycol, butylene glycol, neopentyl glycol, triethylene glycol, butanediol, hexylene glycol, an adduct of bisphenol A with ethylene oxide (2,2-bis(4-(2-hydroxyethyloxy)phenyl)propane, and 1,4-dihydroxymethylcyclohexane can be mentioned.

In the present invention, various polyesters prepared by condensation (co)polymerization of one or a mixture of these dicarboxylic acids with one or a mixture of these diols can be used. In particular, at least one of the dicarboxylic acids is preferably terephthalic acid. As the dicarboxylic acid component, a mixture of terephthalic acid and isophthalic acid (in a molar ratio of from 9/1 to 2/8), or a mixture of terephthalic acid and naphthalenedicarboxylic acid (in a molar ratio of from 9/1 to 2/8), is also preferably used. As the diol, ethylene glycol or a mixed diol containing ethylene glycol is preferably used. Preferably the molecular weight of these polymers is 30,000 to 50,000.

Also, a mixture of two or more of these polyesters having different compositions is preferably used. Further, a mixture of these polyesters with other resins can also be used preferably. As the other resins that can be mixed, wide varieties of resins that can be extruded at 270° to 350° C. can be chosen, such as polyolefins, for example polyethylenes and polypropylenes; polyethers, for example polyethylene glycols, polyoxymethylenes, and polyoxypropylenes; polyester polyurethanes; polyether polyurethanes; polycarbonates; and polystyrenes. One or more of these resins can be blended. For instance, 90 wt % of a polyethylene terephthalate can be mixed with 6 wt % of a polyethylene and 4 wt % of a polypropylene. Although the mixing ratio of the polyester to the other resin varies depending on the type of the resin to be mixed, in the case of polyolefins, suitably the weight ratio of the polyester to the other resin is from 100/0 to 80/20. If the ratio falls outside this range, the physical properties of the mixed resin drop drastically. In the case of resins other than polyolefins, the polyester is mixed with the resin in a weight ratio ranging from 100/0 to 50/50. If the weight % of the polyester is 50 or less, the effect of the present invention cannot be obtained satisfactorily.

As the white pigment to be mixed and dispersed into the polyester of the reflective support in the present invention, inorganic pigments, such as titanium oxide, barium sulfate, lithopone, aluminum oxide, calcium carbonate, silicon oxide, antimony trioxide, titanium phosphate, zinc oxide, white lead, and zirconium oxide; and organic finely divided powders, such as finely divided powders of a polystyrene and a styrene/divinylbenzene copolymer, can be mentioned.

Among these pigments, titanium dioxide is particularly effectively used. The titanium dioxide may be of the rutile type or the anatase type, and it may be one prepared by either the sulfate process or the chloride process. The pigment can be commercially available, such as KA-10 and KA-20, manufactured by Titan Kogyo and A-220, manufactured by Ishihara Sangyo.

Preferably, the white pigment to be used has an average particle diameter of 0.1 to 0.8 μm. If the particle diameter is too small, it is difficult to disperse the pigment uniformly into the resin. On the other hand, if the particle diameter is too large, the whiteness becomes unsatisfactory and the coated surface becomes rough, thereby adversely affecting the image quality.

The mixing weight ratio of the polyester resin to the white pigment is from 95/5 to 30/70 (polyester/white pigment), preferably from 90/10 to 50/50, and particularly preferably from 90/10 to 60/40. If the amount of the white pigment is too small, the whiteness is insufficient; while if the amount is too large, the smoothness of the surface of the obtained support for photographic paper is unsatisfactory and a support for photographic paper excellent in glossiness cannot be obtained.

The polyester and the white pigment are mixed together with a dispersing agent, such as a metal salt of a higher fatty acid, a higher fatty acid ethyl ester, a higher fatty acid amide, and a higher fatty acid, by a kneader, such as a twin roll, a triplet roll, a kneader, and a Banbury mixer. Into the resin layer, an antioxidant may be contained in the resin layer in an amount of 50 to 1,000 ppm based on the resin.

The thickness of the polyester/white pigment composition that is coated on the surface to be emulsion-coated of the base paper of the present reflective support is preferably 5 to 100 μm, more preferably 5 to 80 m, and particularly preferably 10 to 50 μm. If the thickness is more than 100 μm, problems related to the physical properties arise and, for example, the resin becomes too brittle and cracks. On the other hand, if the thickness is less that 5 μm, the waterproofness of the coating that is originally intended is apt to be damaged; in addition, the whiteness and the surface smoothness cannot be satisfied simultaneously; and with respect to the physical properties the coating becomes too soft.

The above smoothness is represented by using the surface roughness of the support as a scale. This surface roughness of the support will now be described.

The surface roughness uses the center line average surface roughness as a scale.

The center line average surface roughness is defined as follows. An area SM is cut out from the rough curved surface at the center surface thereof, the X-axis and the Y-axis of the rectangular coordinate axes are placed on the center line of the cutout, the axis orthogonal to the center line is assumed to be the Z-axis, and then the value given by the following expression is defined as the center line average surface roughness (SRa) in μm.

$$SRa = \frac{1}{SM} \int_0^{L_X} \int_0^{L_Y} |f(X, Y)| dX \cdot dY$$

wherein LxLy=SM and Z=f(X,Y)

The values of the center line average surface height and the height of the projection from the center line can be found by measuring an area of 5 $mm^2$ using, for example, a three-dimensional surface roughness tester (SE-30H) manufactured by Kosaka-kenkyusho KK), which has a diamond needle having a diameter of 4 μm, with the cutoff value being 0.8 mm, the horizontal scale-up ratio being 20, and the vertical scale-up ratio being 2,000. At that time, the feeding speed of the sensing needle is preferably on the order of 0.5 mm/sec. Based on this measurement, preferably, the support has a value of 0.15 μm or less, more preferably 0.10 μm or less. Using a support having such a surface roughness (smoothness), a color print having a surface excellent in smoothness can be obtained.

Preferably the thickness of the resin or the resin composition that covers the surface opposite to the emulsion-coated surface of the base paper is 5 to 100 μm, more preferably 10 to 50 μm. If it is too thick, problems related to the physical properties arise and, for example, the resin becomes too brittle and cracks. If it is too thin, the waterproofness of the covering that is originally intended is impaired; and in addition with respect to the physical properties the covering becomes too soft. As preferable resin for use in covering the opposite surface to the emulsion-coated surface can be mentioned polyethylene terephthalate.

As a process for covering the surface to be emulsion-coated and the opposite surface, for example, the melt extrusion lamination process can be mentioned.

The base paper to be used for the base of the reflective support of the present invention is chosen from materials generally used for photographic paper. That is, the main raw material is natural pulp from, for example, softwoods or hardwoods, to which, if necessary, is added, for example, a filler, such as clay, talc, calcium carbonate, and urea resin fine particles, a sizing agent, such as a rosin, an alkylketene dimer, a higher fatty acid, an epoxidized fatty acid amide, paraffin wax, and an alkenyl succinate, a paper strength booster, such as a starch, a polyamide polyamine epichlorohydrin, and a polyacrylamide, and a fixing agent, such as aluminum sulfate, and a cationic polymer.

Although the kind and thickness of the base paper support are not particularly restricted, desirably the basis weight is 50 g/m$^2$ to 250 g/m$^2$. Preferably, the base paper is surface-treated by applying heat and pressure thereto, for example, by a machine calender or a supercalender in order to increase the smoothness and flatness of the support.

Before the base paper is coated with the mixed composition of a polyester and a white pigment, preferably the surface of the base paper is pretreated, for example, with a corona discharge treatment, a flame treatment, or an undercoat.

When a polyester, such as a polyethylene terephthalate, is used, since the adhesion to the photographic emulsion is weak in comparison with the case wherein a polyethylene is used, preferably, after the melt extrusion lamination of the polyester to the base paper, the polyester surface is subjected to a corona discharge treatment and a hydrophilic colloid layer is applied.

Also preferably the surface of the thermoplastic resin mainly made up of a polyester is coated with an undercoat liquid containing a compound represented by the following formula (U):

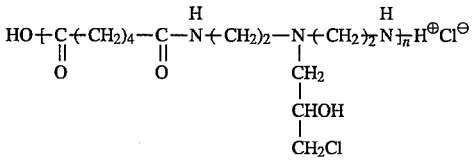

Preferably the coating amount of the compound represented by formula (U) is 0.1 mg/m$^2$ or more, more preferably 1 mg/m$^2$ or more, and most preferably 3 mg/m$^2$ or more, and the larger the amount is, the higher the adhesion can be increased, but an excessive amount is disadvantageous in view of cost.

In order to improve the applicability of the undercoat solution to the resin surface, preferably alcohols, such as methanol, are added. In this case, the proportion of the alcohols is preferably 20 wt % or more, more preferably 40 wt % or more, and most preferably 60 wt % or more. To improve the applicability further, various surface-active agents, such as anionic surface-active agents, cationic surface-active agents, nonionic surface-active agents, fluorine-containing surface-active agents, and organosilicon surface-active agents, are preferably added.

Further, preferably, a water-soluble polymer, such as gelatin, is added to obtain a good surface coated with the undercoat.

In view of the stability of the compound of formula (U) into consideration, preferably the pH of the solution is 4 to 11, more preferably 5 to 10.

Before applying the undercoat liquid, preferably the thermoplastic resin surface is treated. As the surface treatment, for example, a corona discharge treatment, a flame treatment, or a plasma treatment can be used.

To apply the undercoat solution, a generally well-known coating process can be used, such as the gravure coating process, the bar coating process, the dip coating process, the air-knife coating process, the curtain coating process, the roller coating process, the doctor coating process, and the extrusion coating process.

The drying temperature of the coat is preferably 30° to 100° C., more preferably 50 to 100° C., and most preferably 70° to 100° C.; the upper limit is determined by the heat resistance of the resin, and the lower limit is determined by the production efficiency.

The color-mix inhibitor for use in the present invention will now be described in detail.

As described, for example, in U.S. Pat. No. 4,732,845, the term "a color-mix inhibitor" refers to one that is placed in a nonphotosensitive layer (a color-mix-prevention layer) situated between photosensitive layers in order to prevent color-mixing (color amalgamation) that will be caused by diffusion of the oxidized product of a color developing agent produced in photosensitive emulsion layers into other photosensitive layers, which oxidized product will react with the coupler present therein to form color.

The color-mix inhibitor having a molecular weight of 350 or more for use in the present invention may have any structure if it functions to prevent color-mixing and examples include hydroquinones described, for example, in U.S. Pat. No. 4,732,845, and JP-B Nos. 12250/1976 and 13748/1986, and EP 69070A, gallic acids described in JP-B No. 34372/1989, sulfonamidophenols described in EP 98072A, and compounds described in JP-A Nos. 154051/1991 and 164735/1991.

Out of the color-mix inhibitors for use in the present invention, those represented by the following formula (I) are particularly preferable.

formula (I)

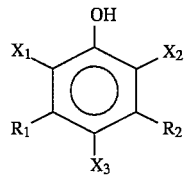

wherein $X_1$, $X_2$, $X_3$, $R_1$, and $R_2$ each represent a hydrogen atom or a substituent, and at least one of $X_1$, $X_2$, and $X_3$ represents a hydroxyl group or a sulfonamido group, provided that $X_1$, $X_2$, $X_3$, $R_1$, and $R_2$ are selected such that the molecular weight of the compound is 350 or more, the substituents in the ortho-positions relative to each other may bond together to form a ring, and any of $X_1$, $X_2$, $X_3$, $R_1$, and $R_2$ may be bonded to a polymer chain or may be bonded to a compound represented by formula (I) to form a dimer or a higher polymer.

The compound represented by formula (I) is described in detail below.

As specific examples of the substituents represented by $X_1$, $X_2$, $X_3$, $R_1$, and $R_2$ of formula (I), can be mentioned a halogen atom, a nitro group, a cyano group, a hydroxyl group, a carboxyl group, a sulfo group, an amino group, an alkyl group (including straight-chain alkyl, branched alkyl, and cycloalkyl groups), an aryl group, an alkoxy group, an aryloxy group, an alkylthio group, an arylthio group, an acyl group, a sulfonyl group, a carbamoyl group, a sulfamoyl group, an alkoxycarbonyl group, an alkoxysulfonyl group, an amido group, a sulfonamido group, a ureido group, and a urethane group, which can be further substituted by other group (e.g., those groups mentioned above) if possible.

In formula (I), $X_3$ preferably represents a hydroxyl group or a sulfonamido group, $X_1$, $X_2$, $R_1$, and $R_2$each preferably represent a hydrogen atom, a halogen atom, an alkyl group, an aryl group, an amido group, or a ureido group.

In formula (I), particularly preferably $X_3$represents a hydroxyl group and at least one of $X_1$, $X_2$, $R_1$, and $R_2$ represents an alkyl group (preferably the alkyl group has 10 or more carbon atoms, and although there is no particular restriction on the upper limit of the number of carbon atoms, preferably the number of carbon atoms is 18 or less from a practical point of view), and the others each represent a hydrogen atom. More preferably $X_2$ and $R_1$each represent an unsubstituted straight-chain or branched alkyl group and $X_1$ and $R_2$ each represent a hydrogen atom.

It is required that the molecular weight of the color-mix inhibitor for use in the present invention is 350 or more. Preferably the molecular weight is 390 or more, more preferably 440 or more, and most preferably 500 or more. If the color-mix inhibitor is a polymer, the molecular weight is represented in terms of the number-average molecular weight. If the color-mix inhibitor is a polymer, the upper limit of the molecular weight of the color-mix inhibitor is not particularly restricted, but if the color-mix inhibitor is a compound other than a polymer, preferably the molecular weight is about 1,000 or less. When the color-mix inhibitor is a polymer, its molecular weight is preferably 3,000 to 200,000, more preferably 10,000 to 100,000.

The total amount of the color-mix inhibitor contained in at least two intermediate layers, each arranged between silver halide emulsion layers, is preferably 0.05 to 0.5 g/m$^2$, more preferably 0.05 to 0.4 g/m$^2$ and further more preferably 0 1 to 0 3 g/m$^2$ Specific examples of the color-mix inhibitor having a molecular weight of 350 or more for use in the present invention are given below, but the present invention is not restricted to them.

In the following, M.W. stands for molecular weight.

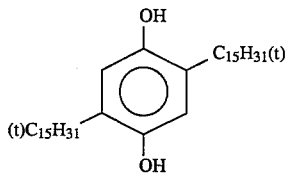

M.W. = 530.9 I-1

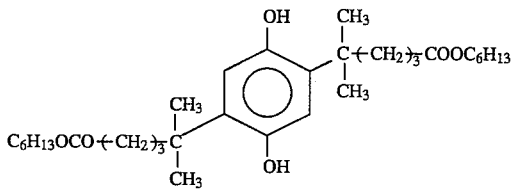

M.W. = 534.8 I-2

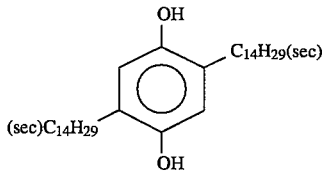

M.W. = 503.0 I-3

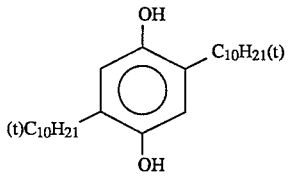

M.W. = 390.7 I-4

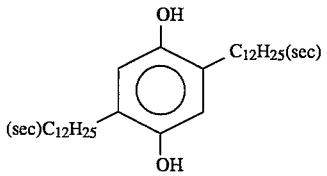

M.W. = 446.8 I-5

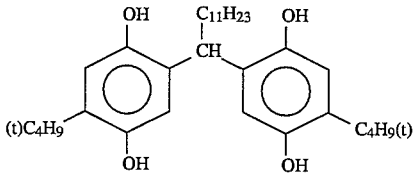

M.W. = 498.8 I-6

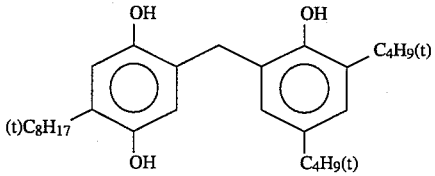

M.W. = 440.7 I-7

-continued
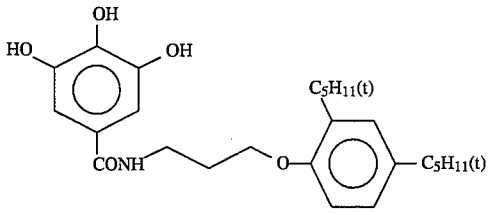
M.W. = 443.6 I-8
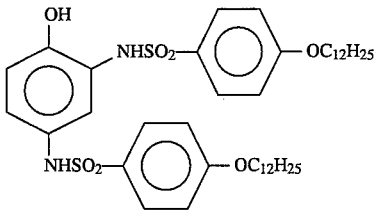
M.W. = 773.1 I-9
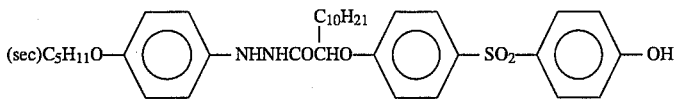
M.W. = 624.8 I-10
average M.W. = ca. 3,000 I-11
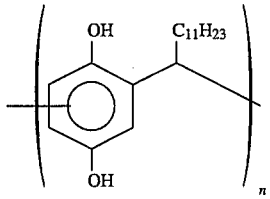
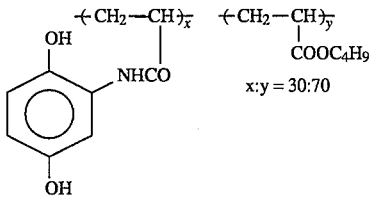
average M.W. = ca. 30,000 I-12
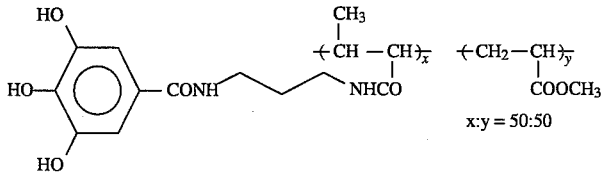
average M.W. = ca. 10,000 I-13
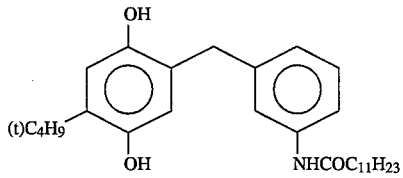
M.W. = 453.6 I-14
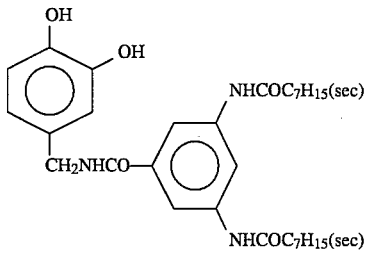
M.W. = 525.7 I-15

-continued
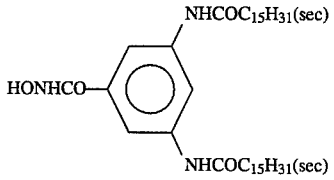
M.W. = 644.0 I-16
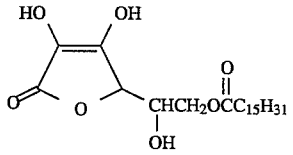
M.W. = 414.5 I-17
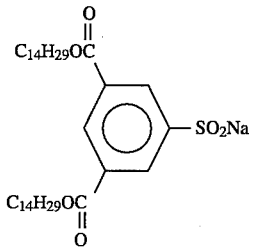
M.W. = 644.9 I-18
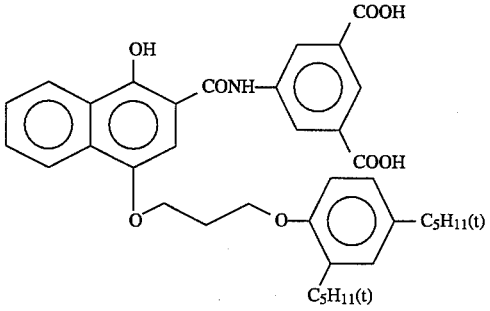
M.W. = 641.8 I-19
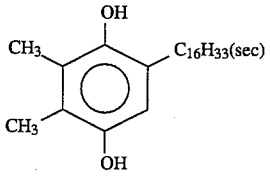
M.W. = 362.6 I-20
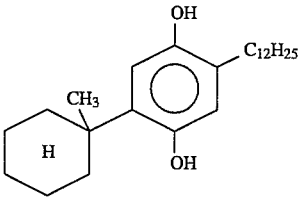
M.W. = 374.6 I-21
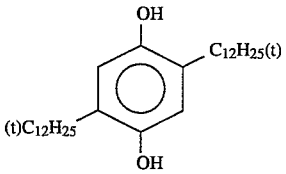
M.W. = 446.8 I-22

-continued
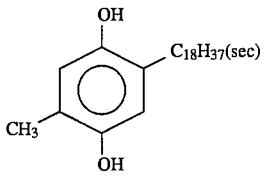
M.W. = 376.6 I-23
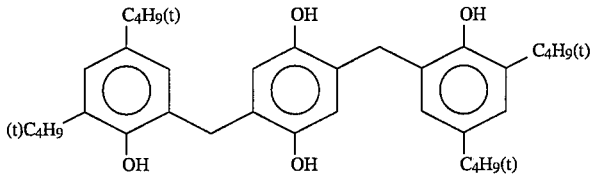
M.W. = 546.8 I-24
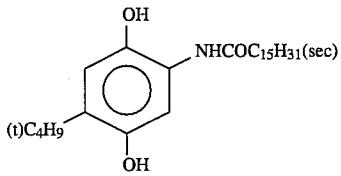
M.W. = 419.7 I-25
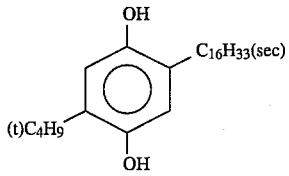
M.W. = 390.7 I-26
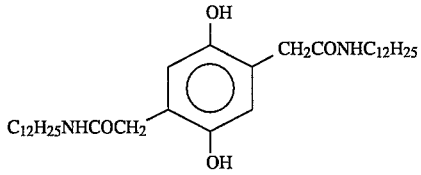
M.W. = 560.9 I-27
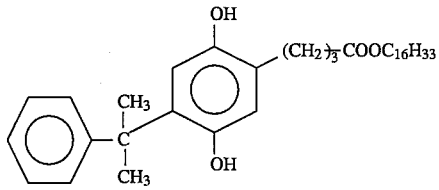
M.W. = 538.8 I-28
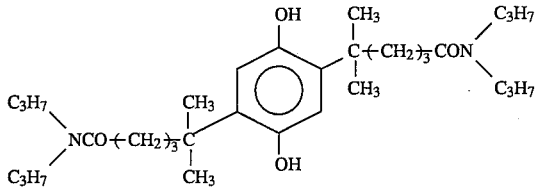
M.W. = 532.8 I-29
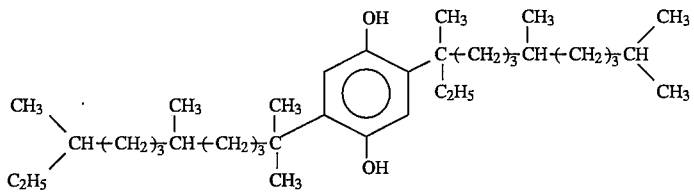
M.W. = 530.9 I-30
The color-mix inhibitor for use in the present invention can be synthesized by the methods described in the above publications and by methods based on them. Particularly, alkylhydroquinones can be synthesized in accordance with the following synthesis example.

Synthesis Example (Synthesis of Exemplified Compound II-5)

3.3 Grams (17 g can also be possible) of Amberlyst 15 (an ion-exchange resin manufactured by Rohm & Hass Co.) was charged into a three-neck flask into which 33 g of hydroquinone and 111 g of 1-dodecene had been placed, and the internal temperature was elevated to 110° C. with stirring. After the reaction was continued for 3 hours at that temperature, the internal temperature was elevated to 140° C. and the reaction was continued further for 5 hours. After the system was cooled, n-hexane and ethyl acetate were added and the ion exchange resin was filtered off, followed by concentration. The concentrate was purified by silica gel chromatography, to obtain 72 g of an oil of an isomer mixture of Compound II-5.

In the present invention, a yellow coupler having a relative coupling rate of 0.20 or over, preferably 0.20 to 10 is used. The term "relative coupling rate" in the specification and claim of the present invention was defined by the following method: the 25 following single-layer-applied sample and color developers (A and B) were used; the following processing steps were followed; the amount of the developed silver ($Ag^0$) and the color density (Dye) that were obtained under several amounts of exposure to light were measured; Dye was plotted against $Ag^0$ and when the gradient of the linear portion of the color developer A was given by tan A and the gradient of the linear portion of the color developer B was given by tan B, the relative coupling rate was given by the value represented by the following X:

$$X = \frac{1}{\frac{\tan A}{\tan B} - 1}$$

Monolayer coated sample

| |
|---|
| Support |
| Polyethylene terephthalate film |
| under-coated |
| First layer |
| Silver chlorobromide emulsion (contained |
| Silver 8 |
| mmol/m$^2$ |
| 70 mol % of silver bromide) |
| Coupler |
| 1 |
| mmol/m$^2$ |
| Trioctyl phosphate |
| 0.8 |
| g/m$^2$ |
| Sodium dodecylbenzenesulfonate |
| 0.08 |
| g/m$^2$ |
| Gelatin |
| 4 |
| g/m$^2$ |
| Hardener (1-oxy-3,5-dichloro-s- |
| 3.2 |
| mg/m$^2$ |
| triazine sodium salt) |
| Second layer |

-continued

| | | |
|---|---|---|
| Gelatin | | 1 g/m$^2$ |
| Hardener (the same as the above) | | 8.0 mg/m$^2$ |
| Color-developer | A | B |
| Water | 800 ml | 800 ml |
| Potassium bromide | 0.6 g | 0.6 g |
| Sodium hydrogencarbonate | 0.7 g | 0.7 g |
| Potassium carbonate | 31.7 g | 31.7 g |
| Sodium sulfite | 0.3 g | 0.3 g |
| N-Ethyl-N-(β-methanesulfonamido-ethyl)-3-methyl-4-aminoaniline sulfonate | 4.5 g | 4.5 g |
| Citrazinic acid | — | $1 \times 10^{-2}$ mol |
| Water to make | 1000 ml | 1000 ml |
| pH (25°C.) | 10.25 | 10.25 |
| Stopping solution | | |
| Aqueous 1 wt % acetic acid solution | | |
| Processing process | | |
| Color-developing bath (33° C., 3 min 30 sec) → | | |
| Stopping bath (33° C., 1 min) → | | |
| Fixing bath (33° C., 5 min) → | | |
| Water-washing (25 to 35° C., 3 min) → | | |
| Drying → | | |
| Determination of silver amount (fluorescent X-ray) → | | |
| Bleaching bath (38° C., 6 min) → | | |
| Fixing bath (38° C., 4 min) → | | |
| Water-washing (25 to 35° C., 3 min) → | | |
| Drying → | | |
| Determination of density (Densitometer FCD-103, manufactured by Fuji Photo Film Co.) | | |

Two sheets of each sample were subjected to a gradation exposure to light, each of which was processed by the above-shown processing process using color developer A or B, to determine Dye/$Ag^0$.

When the value of the coupling rate is determined, the average grain size of the oil droplets of the emulsion is adjusted to between 0.1 to 0.3 μm. Herein, the average grain size can be determined easily by the method of Gledhill and Julian, described in *J. Phys. Chem.*, 66,458 (1961). In the above processing steps, as the fixing solution and the bleaching solution Bleaching Solution (N2) and Fixing Solution (N3) of commercially available Color Negative Film Processing Agent CN-16, manufactured by Fuji Photo Film Co., Ltd, are used.

The "relative coupling rates" of typical yellow couplers measured by the above method are given below, and they are classified into those falling within the present invention and those falling outside the present invention.

(YH-1)
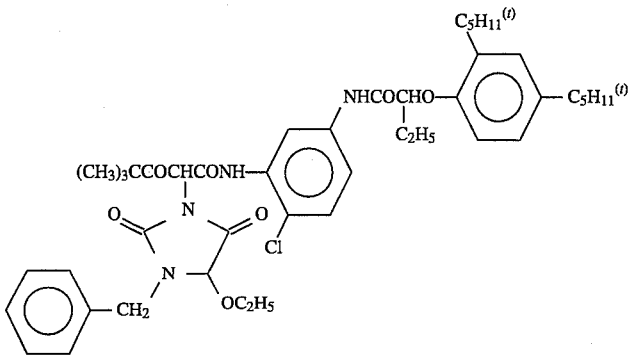
Relative coupling rate: 0.21
(YH-2)
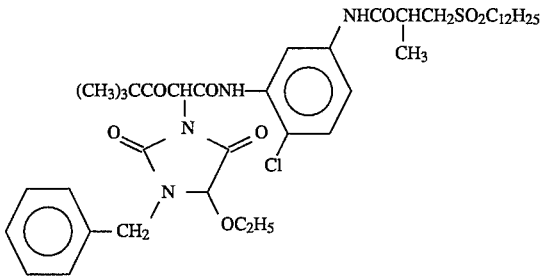
Relative coupling rate: 0.31
(YH-3)
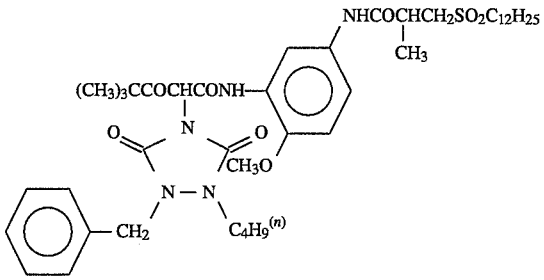
Relative coupling rate: 0.29
(YH-4)
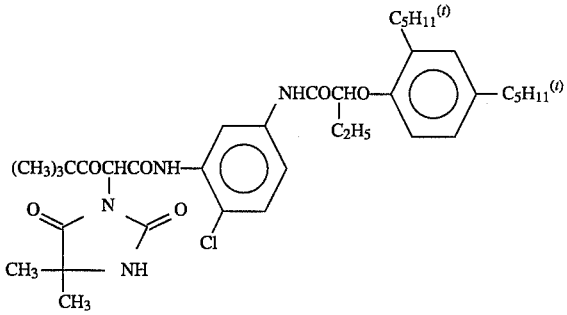
Relative coupling rate: 0.33

-continued
(YH-5)
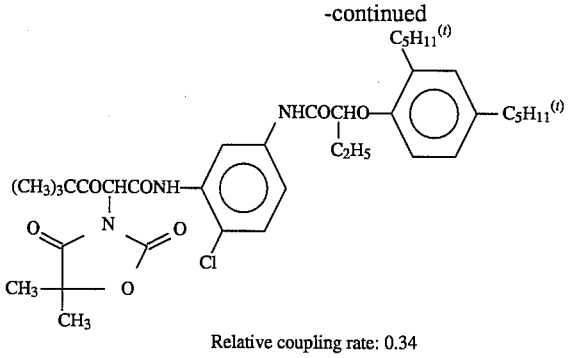
Relative coupling rate: 0.34
(YH-6)
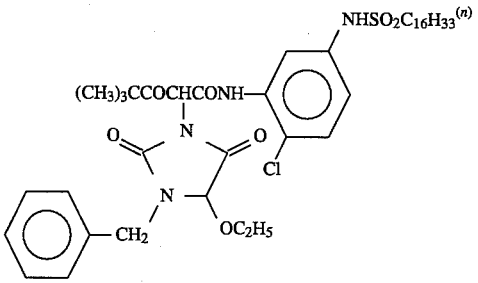
Relative coupling rate: 0.40
(YH-7)
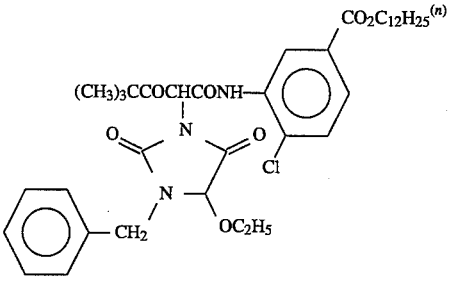
Relative coupling rate: 0.41
(YH-8)
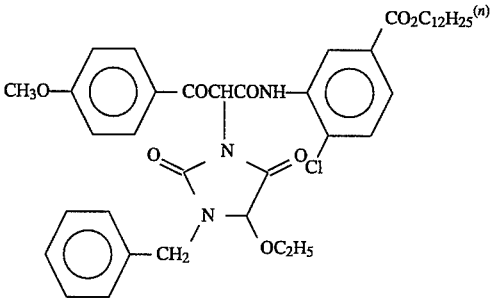
Relative coupling rate: 0.87
(YH-9)
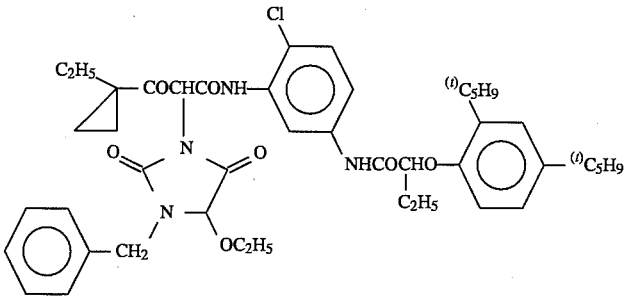
Relative coupling rate: 0.60

-continued (YH-10)

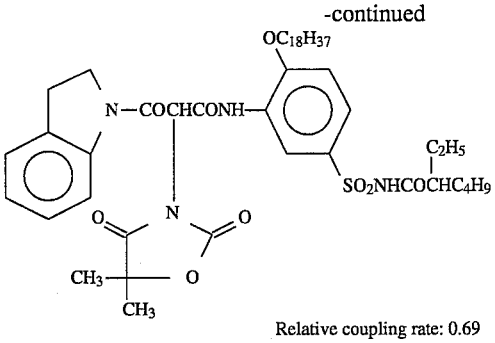

Relative coupling rate: 0.69

(YH-11)

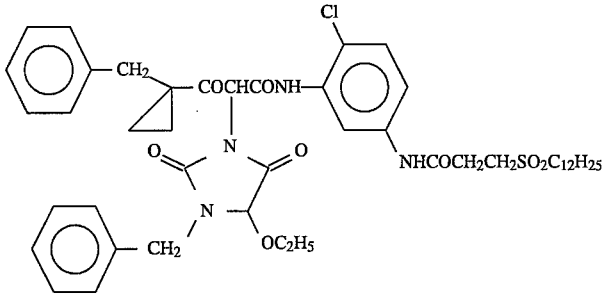

Relative coupling rate: 0.85

Yellow couplers preferably used in the present invention that have relative coupling rates within the above-specified range include, in addition to preferable compounds out of the above-mentioned compounds, acylacetamide yellow couplers whose acyl group has a 3- to 5-membered ring structure described in European Patent EP No. 0447969 A 1, malondianilide yellow couplers having a ring structure described in European Patent EP No. 0482552 A 1, and acylacetamide yellow couplers having a dioxane structure described in U.S. Pat. No. 5,118,599. Among them, acylacetamide yellow couplers whose acyl group is a 1-alkylcyclopropane-1-carbonyl group and malondianilido yellow couplers wherein one of the anilides constitutes an indoline ring, are particularly preferably used. These couplers can be used alone or in combination.

In the present invention, the yellow coupler is used generally in an amount of 0.002 to 0.5 mol, preferably 0.01 to 0.5 mol, per mol of the photosensitive silver halide in the same layer.

The yellow coupler of the present invention can be introduced into the photographic material by various known dispersion methods. The yellow coupler can be added by the oil-in-water dispersion method generally known as the oil-protected method, wherein the yellow coupler is dissolved in a solvent and then is emulsified and dispersed in an aqueous gelatin solution containing a surface-active agent. Alternatively, water or an aqueous gelatin solution is added to a surface-active-agent-containing solution of the yellow coupler of the present invention, to form an oil-in-water dispersion with the phase inversion of emulsion. If the yellow coupler of the present invention is soluble in an alkali, it can be dispersed by the so-called Fisher dispersion method. From the yellow coupler dispersion of the present invention, the low-boiling organic solvent may be removed, for example, by distillation, noodle washing, or ultrafiltration, and then it may be mixed with a photographic emulsion.

In the present invention, when the yellow coupler is introduced into the photographic material by the oil-in-water dispersion method, a high-boiling organic solvent can be used in a weight ratio of from 4.0 to 0, preferably from 2.0 to 0, to the coupler (this includes the case wherein no high-boiling organic solvents are used). The high-boiling organic solvent used in the same layer in which the yellow coupler is used is preferably one having a relative dielectric constant of 20 to 2, more preferably 15 to 2, measured at 25° C. and 10 kHz.

The color photographic material of the present invention can be formed by applying at least one yellow-color-forming silver halide emulsion layer, at least one magenta-color-forming silver halide emulsion layer, and at least one cyan-color-forming silver halide emulsion layer on a support having a reflective layer. In a common color photographic printing paper, by adding couplers capable of forming dyes having relationships complementary to lights to which the silver halide emulsions are sensitive, the color can be reproduced by the subtractive color process. A common color photographic printing paper can be formed in such a manner that silver halide emulsion grains are spectrally sensitized with a blue-sensitive spectral sensitizing dye, a green-sensitive spectral sensitizing dye, and a red-sensitive spectral sensitizing dye, in the order of the above color-forming layers, and they are applied on a support in the above-stated order. However, the order may be different. In view of the rapid processing, there is a case wherein a photosensitive layer containing silver halide grains having the greatest average grain size is preferably the uppermost layer; or in view of the preservability under exposure to light, there is a case wherein the lowermost layer is preferably a magenta color-forming photosensitive layer.

The photosensitive layers and the hues that will be formed by color forming may be formed not to have the above correspondence, and at least one infrared photosensitive silver halide emulsion layer can be used.

In the present invention, it is required that, as the silver halide grains, silver chloride grains, silver chlorobromide grains, or silver chloroiodobromide grains containing 90 mol % or more of silver chloride are used. Particularly, in the present invention, in order to shorten the development processing time, silver chlorobromide grains or silver chloride grains substantially free from silver iodide can preferably be used. Herein the expression "substantially free from silver iodide" means that the silver iodide content is 1 mol % or less, preferably 0.2 mol % or less. On the other hand, for the purpose of increasing high-intensity sensitivity, spectral sensitization sensitivity, or long-term stability of the photographic material, there is a case wherein high-silver-chloride grains containing 0.01 to 3 mol % of silver iodide on the emulsion surface is preferably used as described in JP-A No. 84545/1991. Although the halogen composition of the emulsion may be different or uniform from grain to grain, when an emulsion having a halogen composition uniform from grain to grain is used, the properties of the grains can be easily made homogeneous. With respect to the halogen composition distribution in the silver halide emulsion grains, for example, grains having the so-called uniform-type structure, wherein the halogen composition is uniform throughout the grains; grains having the so-called layered-type structure, wherein the halogen composition of the core in the silver halide grains is different from that of the shell (consisting of a layer or layers) surrounding the core; or grains having a structure wherein non-layered parts different in halogen composition are present in the grains or on the surface of the grains (if the non-layered parts different in halogen composition are present on the surface of the grains, they may be joined to the edges, corners, or planes of grains) may suitably be chosen. To secure a high sensitivity, it is more advantageous to use one of the latter two than to use grains having a uniform-type structure and the latter two are also preferable in view of pressure-resistance properties. If the silver halide grains have the above structure, the boundary of parts different in halogen composition may be a clear boundary, an obscure boundary formed by a mixed crystal due to the difference of the composition, or a boundary wherein the structure is continuously changed positively.

In the high-silver-chloride emulsion for use in the present invention, preferably the silver bromide localized phase is layered or non-layered in the silver halide grains and/or on the surface of the grains as described above. The halogen composition of the above localized phase preferably has a silver bromide content of at least 10 mol %, more preferably the content is more than 20 mol %. The silver bromide content of the silver bromide localized layer can be analyzed, for example, by using the X-ray diffraction method (described, for example, in *Shin-jikkenkagaku-koza* 6, *Kozokaiseki*, edited by Nihonkagakukai, published by Maruzen). The localized phase may be present in the grains or on the edges, corners, or planes of the grains and one preferable example is one wherein the localized phase is grown epitaxially on the corners of the grains.

For the purpose of decreasing the replenishing amount of the development processing solution, it is effective to increase further the silver chloride content of the silver halide emulsion. In that case, an emulsion comprising nearly pure silver chloride, for example an emulsion having a silver chloride content of 98 to 100 mol %, is also preferably used.

The average grain size of the silver halide grains contained in the silver halide emulsion used in the present invention (the average grain size is calculated in such a way that, by assuming the diameters of circles equivalent to the projected areas of the grains to be the grain sizes, its number average is designated as the average grain size) is preferably 0.1 to 2 μm.

The grain size distribution of them is preferably a monodisperse distribution wherein the deviation coefficient (which is obtained by dividing the standard deviation of the grain size distribution by the average grain size) is preferably 20% or less, desirably 15% or less, and more preferably 10% or less. At that time, for the purpose of obtaining a wide latitude, it is also preferably carried out that such monodisperse emulsions are blended to be used in one layer or are applied in layers.

With respect to the form of the silver halide grains contained in the photographic emulsion, a regular crystal form, such as a cubic form, a tetradecahedral form, or an octahedral form, an irregular crystal form, such as a sphere form or a tabular form, or a composite of these can be used. Also a mixture of various crystal forms can be used. In the present invention, it is desired that, out of these, the above regular crystal form amounts to 50% or more, preferably 70% or more, and more preferably 90% or more, in the grains.

Besides these, an emulsion wherein tabular grains having an average aspect ratio (the diameter/thickness in terms of circles) of 5 or more, preferably 8 or more, amount to over 50% in all the grains in terms of projected areas can be preferably used.

The silver (bromo)chloride emulsion used in the present invention can be prepared by processes described, for example, by P. Glafkides in *Chimie et Phisigue Photographigue* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, and the like can be used and to react a soluble silver salt with a soluble halide, any of the single-jet method, the double-jet method, a combination of these, and the like can be used. A method wherein grains are formed in an atmosphere of excess silver ions (so-called reverse precipitation method) can also be used. As one type of the reverse precipitation method, a method wherein the pAg in the liquid phase wherein the silver halide will be formed is kept constant, that is, the so-called controlled double-jet method can be used. According to this method, a silver halide emulsion wherein the crystal form is regular and the grain size is nearly uniform can be obtained.

The localized phase of the silver halide grains of the present invention or its substrate preferably contains different metal ions or their complex ions. Preferable metal ions are selected from ions of metals belonging to Groups VIII and IIb of the Periodic Table, their complex ions, lead ions, and thallium ions. Mainly, in the localized phase, ions selected from iridium ions, rhodium ions, and iron ions, and their complex ions, can be used; and mainly, in the substrate, ions of metals selected from osmium, iridium, rhodium, platinum, ruthenium, palladium, cobalt, nickel, iron, etc., and their complex ions can be used in combination. The localized phase and the substrate may be different in their kind of the metal ions and the concentration of the metal ions. Several of these metals can be used. Particularly, it is preferable to allow an iron compound and an iridium compound to be present in the silver bromide localized phase.

These metal-ion-providing compounds are incorporated in the localized phase of the silver halide grains of the present invention and/or some other grain part (substrate) at the time of the formation of silver halide grains by means, for example, of adding them into an aqueous gelatin solution, an aqueous halide solution, an aqueous silver salt solution, or other aqueous solution serving as a dispersing medium, or by adding silver halide fine grains already containing the metal ions and dissolving the fine grains.

The metal ions to be used in the present invention may be incorporated in emulsion grains before, during, or immediately after the formation of the grains, which time will be selected depending on their position in the grains.

Generally the silver halide emulsion used in the present invention is chemically and spectrally sensitized.

With respect to the chemical sensitization, a chemical sensitization, which uses a chalcogen sensitizer (specifically, sulfur sensitization, which typically includes the addition of an unstable sulfur compound; selenium sensitization, which uses a selenium compound; or tellurium sensitization, which uses a tellurium compound), a noble metal sensitization, which typically includes gold sensitization, and a reduction sensitization can be used alone or in combination. With respect to compounds used in chemical sensitization, those described in JP-A No. 215272/1987, page 18 (the right lower column) to page 22 (the right upper column), are preferably used.

Effects of the photographic material constitution of the present invention can be obtained when a gold-sensitized high-silver-chloride emulsion is used.

The emulsion used in the present invention is a so-called surface latent image-type emulsion, wherein a latent image is mainly formed on the grain surface.

In order to prevent fogging during the production step of the photographic material, during the storage thereof, or during the photographic processing, or in order to stabilize the photographic performance thereof, various compounds or their precursors can be added to the silver halide emulsion for use in the present invention. Specific examples of these compounds are preferably those described in the above-mentioned JP-A No. 215272/1987, pages 39 to 72. Further, 5-arylamino-1,2,3,4-thiatriazole compounds (whose respective aryl residues have at least one electron-attracting group) described in EP 0447647 are also preferably used.

Spectral sensitization is carried out for the purpose of spectral sensitizing the emulsion of each layer of the photographic material to a desired wavelength region of light.

In the photographic material of the present invention, as spectral-sensitizing dyes used for spectral sensitizing the blue, green, and red regions, those described by F. M. Harmer in *Heterocyclic compounds-Cyanine dyes and related compounds* (John Wiley & Sons (New York, London), 1964) can be mentioned. As specific examples of the compounds and specific examples of the spectral sensitization method, those described in the above-mentioned JP-A No. 215272/1987, page 22 (the right upper column) to page 38, are preferably used. In particular, as red-sensitive spectral-sensitizing dyes for silver halide emulsion grains high in the silver chloride content, spectral-sensitizing dyes described in JP-A No. 25 123340/1991 are very preferred in view, for example, of stability, strong adsorption, and temperature dependence of exposure to light.

When the photographic material of the present invention is to be effectively spectral-sensitized to the infrared region, sensitizing dyes described in JP-A No. 15049/1991, page 12 (the left upper column) to page 21 (the left lower column); JP-A No. 20730/1991, page 4 (the left lower column) to page 15 (the left lower column); EP-0,420,011, page 4, line 21, to page 6, line 54; EP-0,420,012, page 4, line 12, to page 10, line 33; EP-0,443,466, and U.S. Pat. No. 4,975,362 are preferably used.

In order to incorporate these spectral-sensitizing dyes in the silver halide emulsion, they may be directly dispersed into the emulsion, or they may be first dissolved in a solvent, such as water, methanol, ethanol, propanol, methyl Cellosolve, and 2,2,3,3-tetrafluoropropanol, which solvent may alone or a mixture, and then the solution is added to the emulsion. Also the spectral-sensitizing dye may be made together with an acid or base into an aqueous solution as described in JP-B Nos. 23389/1969, 27555/1969, and 22089/1972, or the dye may be made together with a surface-active agent into a colloid dispersion and the dispersion may be added to the emulsion, as described in U.S. Pat. Nos. 3,822,135 and 4,006,025. Also after the spectral-sensitizing dye may be dissolved in a solvent substantially immiscible with water, such as phenoxyethanol, which solution is then dispersed in water or a hydrophilic colloid and is added to the emulsion. Also the spectral-sensitizing dye may be directly dispersed into a hydrophilic colloid, as described in JP-A Nos. 102733/1978 and 105141/1983, which dispersion is added to the emulsion. The spectral-sensitizing agent may be added to the emulsion at any time at any stage during the preparation of the emulsion that is known to be useful. That is, the timing of the addition may be selected from the point before or during the formation of the grains of the silver halide emulsion; the point immediately after the formation of the grains and before the washing step; the point before and during the chemical sensitization; the point immediately after the chemical sensitization and before the end of the solidification of the emulsion by cooling; and the point of the preparation of the coating solution. Most generally the addition is carried out at the point after the completion of the chemical sensitization and before the application, but, as described in U.S. Pat. Nos. 3,628,969 and 4,225,666, the spectral-sensitizing dye may be added simultaneously with the chemical sensitizer, to carry out the spectral sensitization simultaneously with the chemical sensitization, or, as described in JP-A No. 113928/1983, the spectral-sensitizing dye may be added prior to the chemical sensitization, or the spectral-sensitizing dye may be added before the completion of the precipitation of the silver halide grains to start the spectral sensitization. Further, as taught in U.S. Pat. No. 4,224,666, the spectral-sensitizing dye may be added in portions, that is, a part of the spectral-sensitizing dye may be added prior to the chemical sensitization and the rest may be added after the chemical sensitization and also the spectral-sensitizing dye may be added at any time during the formation of the silver halide grains, for example, as taught in U.S. Pat. No. 4,183,756. Among the above in particular, preferably the spectral sensitizing dye is added before the step of washing the emulsion or before the chemical sensitization.

The amount of these spectral-sensitizing dyes to be added varies widely depending on the case, and is preferably in the range of $0.5\times10^{-6}$ to $1.0\times10^{-2}$ mol, more preferably $1.0\times10^{-6}$ to $5.0\times10^{31\ 3}$ mol, per mol of the silver halide.

In the present invention, when a sensitizing dye having a spectral sensitizing sensitivity particularly to from the red region to the infrared region, preferably compounds described in JP-A No. 157749/1990, page 13 (the right lower column) to page 22 (the right lower column), are used additionally. By using these compounds, the preservability of the photographic material, the stability of the processing of the photographic material, and the supersensitizing effect can be specifically enhanced. In particular, the additional use of compounds of formulas (IV), (V), and (VI) disclosed in the above patent is particularly preferable. These compounds are used in an amount of $0.5\times10^{-5}$ to $5.0\times10^{-2}$ mol, preferably 5.0 x $10^{-5}$ to 5.0×$10^{-3}$ mol, per mol of the silver halide and the advantageous amount to be used lies in the range of 0.1 to 10,000 times, preferably 0.5 to 5,000 times, 1 mol of the sensitizing dye.

The photosensitive material of the present invention is used in a print system using common negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the photographic material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the photographic material can be present in each of the blue region, the green region, and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III-V group semiconductor laser is present now only in from the red region to the infrared region. However, on the laboratory level, the oscillation of a II-VI group semiconductor laser in the green or blue region is confirmed and it is highly expected that these semiconductor lasers can be used inexpensively and stably if production technique for the semiconductor lasers is developed. In that event, the necessity that each of at least two layers has a spectral sensitivity maximum at 670 nm or over becomes lower.

In such scanning exposure, the time for which the silver halide in the photographic material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure-time is defined as the time for which a picture size is exposed with the density of the picture element being 400 dpi, preferably the exposure time is 10–10 sec or less, more preferably $10^{-6}$ sec or less. Further, the exposure time is preferably $10^{-4}$ to $10^{-10}$ sec, more preferably $10^{-6}$ to $10^{-10}$ sec.

In the photographic material according to the present invention, for the purpose of preventing irradiation or halation or of improving, for example, safelight immunity, preferably a dye, which can be decolored by processing (in particular, an oxonol dye or a cyanine dye), as described in European Patent EP 0337490A2, pages 27 to 76, is added to the hydrophilic colloid layer. Herein, the term "be decolored by processing" means that being decolored any one of processing including development, bleaching, fixing (or bleach/fixing), and water-washing, or being decolored at all the processing above-mentioned.

Some of these water-soluble dyes deteriorate the color separation or the safelight immunity if the amount thereof to be used is increased. As a dye that can be used without deteriorating the color separation, a water-soluble dye described in JP-A No. 310143/1991, 310189/1991, or 310139/1991 is preferable.

In the present invention, instead of or in combination with the water-soluble dye, a colored layer capable of being decolored by processing is used. The colored layer used that can be decolored by processing may be arranged in contact with the emulsion layer directly or through an intermediate layer containing a processing color-mix inhibitor, such as gelatin and hydroquinone. This colored layer is preferably located under the emulsion layer (on the side of the support) that will form a primary color which is the same as that of the colored layer. Colored layers corresponding to respective primary colors may all be arranged, or only some of them may be arbitrarily selected and arranged. A colored layer that has been colored to correspond to several primary color regions can also be arranged. The optical reflection density of the colored layer is preferably such that the value of the optical density at the wavelength at which the optical density is highest in the wavelength region used for the exposure (in the visible light region of 400 nm to 700 nm in a usual printer exposure and in the wavelength of the scanning exposure light source to be used in the case of scanning exposure) is 0.2 or higher but 3.0 or lower, more preferably 0.5 or higher but 2.5 or lower, and particularly preferably 0.8 or higher but 2.0 or lower.

To form the colored layer, conventionally known methods can be applied. For instance, a method wherein a dye described in JP-A No. 282244/1990, page 3 (the right upper column) to page 8, or a dye described in JP-A No. 7931/1991, page 3 (the right upper column) to page 11 (the left lower column), is brought into the form of a solid fine particle dispersion and is allowed to be contained in a hydrophilic colloid layer; a method wherein an anionic dye is fixed to a cationic polymer; a method wherein a dye is adsorbed to fine particles, for example, of a silver halide and is fixed into a layer; or a method wherein colloidal silver is used as described in JP-A No. 239544/1988; can be mentioned. As the method for dispersing a fine powder of a dye in the solid state, for example, a method is described in JP-A No. 308244/1990, pages 4 to 13, wherein a fine powder dye, which is substantially insoluble in water at a pH of at least 6 or below, but which is substantially soluble in water at a pH of at least 8, is incorporated. Further, a method wherein an anionic dye is fixed to a cationic polymer is described in JP-A No. 84637/1990, pages 18 to 26. Methods for preparing colloidal silver as a light-absorbing agent are described in U.S. Pat. Nos. 2,688,601 and 3,459,563. Out of these methods, the method wherein a fine powder dye is incorporated, and the method wherein colloidal silver is used, are preferred.

As a binder or protective colloid that can be used in the photographic material according to the present invention, gelatin is advantageously used, but some other hydrophilic colloid can be used alone or in combination with gelatin. As a gelatin, preferably low-calcium gelatin having a calcium content of 800 ppm or less, more preferably 200 ppm or less, is used. In order to prevent various fungi or bacteria from propagating in the hydrophilic colloid layer to deteriorate the image quality, preferably a mildew-proofing agent, as described in JP-A No. 271247/1988, is added.

When the photographic material of the present invention is subjected to printer exposure, preferably a band strip filter described in U.S. Pat. No. 4,880,726 is used. Thus, light color mixing is eliminated and color reproduction is remarkably improved.

An exposed photographic material can be subjected to conventional color development processing, and, in the case of the color photographic material of the present invention, to make the processing rapid, preferably after it is color-developed, it is bleach-fixed. Particularly, when the above high-silver-chloride emulsion is used, the pH of the bleach fix solution is preferably about 6.5 or below, more preferably 6 or below, for the purpose, for example, of accelerating desilvering.

As the silver halide emulsion to be applied to the photographic material of the present invention and the other materials (e.g., additives) and the photographic constitutional layers (including the arrangement of the layers) to be applied thereto and the processing method and additives used in the processing of the photographic material of the present invention, those described in the below-mentioned patent gazettes, particularly in European Patent EP 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column 4 from the bottom to p. 13 upper left column line 17 | p. 28 upper right column line 16 to p. 29 lower right column line 11 and line p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultraviolet absorbing agent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left | — | — |

-continued

| Element constituting photographic material | JP-A No. 215272/1987 | JP-A No. 33144/1990 | EP 0,355,660A2 |
|---|---|---|---|
| | column line 4 | | |
| Developing Agent precursor | p. 155 lower left column line 5 to p. 155 lower right column line 2 | — | — |
| Compound releasing development inhibitor | p. 155 lower right column lines 3 to 9 | — | — |
| Support | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line to p. 18 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 up er left column last line to lower right column line 13 | p. 65 line 32 to p. 66 line 17 |
| Surface-active agent | p. 201 lower left column line 1 to p. 210 upper right column last in | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | |
| Binder (Hydrophilic colloid) | p. 222 lower left column 6 to p. 225 upper left column last line | line p. 38 upper right column lines 8 to 18 | p. 66 lines 23 to 28 |
| Thickening agent | p. 225 upper right column line to p. 227 upper right column line 2 | — | — |
| Antistatic agent | p. 227 upper right column line to p. 230 upper left column line 1 | — | — |
| Polymer latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p 10 upper right column line 5 | p. 39 upper left column line 4 to p. 42 upper left column last line | p. 67 line 14 to p. 69 line 28 |

Note: In the cited part of JP-A No. 215272/1987, amendment filed on March 16, 1987 is included. Further, among the above-mentioned couplers, it is preferred to use so called short wavelenyth-type yellow coupler, described in JP-A Nos. 231451/1988, 123047/1988, 241547/1988, 173499/1989, 213648/1989, and 250944/1989, as a yellow coupler.

Preferably, the cyan, magenta, and yellow couplers are impregnated into loadable latex polymers (e.g., loadable latex polymers described in U.S. Pat. No. 4,203,716) in the presence or absence of a high-boiling organic solvent listed in the above table, or they are dissolved together with water-insoluble and organic solvent-soluble polymers and are emulsified and dispersed into hydrophilic colloid aqueous solution. As water-insoluble and organic solvent-soluble polymers that can be preferably used, homopolymers or copolymers described in U.S. Pat. No. 4,857,449, the seventh column to the fifteenth column, and in International Publication No. WO 88/00723, pages 12 to 30, can be mentioned. More preferably, methacrylate-type polymers or acrylamide-type polymers, particularly acrylamide-type polymers, are used in view of color image stability and the like.

In the photographic material according to the present invention, color image preservability improving compounds as described in European Patent EP 0277589A2 are preferably used together with couplers, particularly, together with pyrazoloazole couplers and pyrrolotriazole couplers.

That is, the use of a compound described in the above-mentioned patent specifications that combines with the aromatic amine developing agent remaining after the color development processing to form a chemically inactive and substantially colorless compound and/or a compound described in the above-mentioned patent specifications that combines with the oxidized product of the aromatic amine color developing agent remaining after the color development processing to form a chemically inactive and substantially colorless compound simultaneously or singly is preferable. This is because, for example, the occurrence of stain or other side effects due to the formation of color formed dyes by the reaction of the color developing agent or its oxidized product remaining in the film during the storage after the processing with couplers can be prevented.

Further, as the cyan couplers, in addition to diphenylimidazole cyan couplers described in JP-A No. 33144/1090, 3-hydroxypyridine cyan couplers described in European Patent EP 0333185A2 (particularly, that formed by attaching a chlorine coupling-off group to the 4-equivalent coupler of Coupler (42) to make it to be 2-equivalent and Couplers (6) and (9) which are listed as specific examples are preferable), cyclic active methylene cyan couplers described in JP-A No. 32260/1989 (particularly Coupler Examples 3, 8, and 34 that are listed as specific examples are preferable), pyrrolopyrazole cyan couplers described in European Patent EP 0456226A1, pyrroloimidazole cyan couplers described in European Patent EP 0484909, and pyrrolotirazole cyan couplers described in European Patents EP 0488248 and EP 491197A1 are preferably used. Among them, pyrrolotriazole cyan couplers are particularly preferably used.

As the magenta couplers used in the present invention, 5-pyrazolone magenta couplers and pyrazoloazole magenta couplers as described in the known literature shown in the above table are used, but in particular, in view, for example, of the hue, the stability of images, and the color forming properties, pyrazolotriazole couplers wherein a secondary or tertiary alkyl group is bonded directly to the 2-, 3-, or 6-position of the pyrazolotriazole ring as described in JP-A No. 65245/1986, pyrazoloazole couplers containing a sulfonamido group in the molecule as described in JP-A No. 65246/1986, pyrazoloazole couplers having an alkoxyphenyl-sulfonamido ballasting group as described in JP-A No. 147254/1986, and pyrazoloazole couplers having an alkoxy group or an aryloxy group in the 6-position as described in European Patent Nos. 226,849A and 294,785A are preferably used.

As the processing method of color photographic material of the present invention, besides methods described in the above-described table, processing materials and processing method described in JP-A No. 207250/1990, p.26 (right lower column line 1) to p.34 (right upper column line 9) and in JP-A No. 97355/1992, p.5 (left upper column line 17) to p.18 (right lower column line 20) are preferable.

According to the present invention, there is provided a silver halide color photographic material that is excellent in sharpness and whose change in color density due to a change in duration from the moment of exposure to light until the development processing is small, even after the silver halide photographic material in the unexposed state is stored, wherein the effect of the invention becomes remarkable when it is subjected to laser scanning exposure, resulting in a more excellent image-forming method.

The present invention will now be described below specifically with reference to Examples, but the invention is not restricted to them.

Example 1

(Preparation of Base Paper)

A wood pulp mixture [bleached sulfate pulp from hardwoods (LBKP)/bleached sulfite pulp from softwoods (NBSP): 2/1]was subjected to beating, to obtain a pulp slurry having 250 ml of Canadian Standard Freeness. After the pulp slurry was diluted with water, based on the pulp weight, 1.0% of an anionic polyacrylamide (Polystrone 195, molecular weight: about 110,000, manufactured by Arakawa Kagaku KK), 1.0% of aluminum sulfate, and 0.15% of a polyamide polyamine epichlorohydrin (available under the trade name Kaimen 557, manufactured by DIC Hercules Co.) were added with stirring. Then based on the pulp weight, 4.0 wt % of epoxidized behenicacid amide and 4.0 wt % of an alkylketene dimer (whose alkyl group is $C_{20}H_{41}$) were added; then sodium hydroxide was added, to bring the pH to 7, and 0.5 wt % of a cationic polyacrylamide and 0.1 wt % of an antifoamer were added. The thus prepared pulp slurry was made into a sheet of paper having a basis weight of 180 g/m$^2$.

The water content of the thus prepared base paper was brought by an oven to about 2 wt %, and then the base paper was size-pressed with an aqueous solution having the following formulation as a surface sizing solution, so that the coating amount of the solution on the surface of the base paper (on the side where photographic emulsions would be applied) might be 20 g/m$^2$.

| | |
|---|---|
| Poly(vinyl alcohol): | 4.0 wt % |
| Calcium chloride: | 4.0 wt % |
| Fluorescent brightening agent: | 0.5 wt % |
| Antifoamer: | 0.005 wt % |

The thickness of the paper after size-press treated was adjusted by a machine calender to 180 μm.

(Preparation of a Support)

A mixed composition of a polyester (limiting viscosity: 6.5), synthesized by condensation polymerization of a dicarboxylic acid composition shown in Table 1 with ethylene glycol, or polyethylene and titanium oxide (KA-10, manufactured by Titan Kogyo), was melted and mixed at 300° C. by a twin-screw mixing extruder and was melt-extruded from a T-die onto the surface of the 180 μm thickness base paper, so that a lamination layer having a thickness of 30 m might be formed. A calcium carbonate-containing polyethylene terephthalate resin composition was melt-extruded at 300° C. onto the other surface, so that a lamination layer having a thickness of 30 μm might be formed. Thus, a laminated reflective support of this invention was obtained. The resin surface to be emulsion-coated of this laminated reflective support was subjected to a corona discharge treatment and was coated with a coating solution having the following composition in an amount of 5 ml of solution per m$^2$, and it was dried at 80° C. for 2 min,

| [Formulation of the Undercoat] | | |
|---|---|---|
| Compound ExU1 | 0.2 | g |
| Compound ExU2 | 0.001 | g |
| $H_2O$ | 35 | ml |
| Methanol | 65 | ml |
| Gelatin | 2 | g |
| pH | 9.5 | |

ExU1

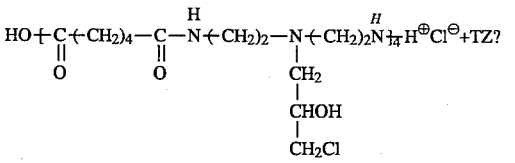

ExU2 $C_{12}H_{25}O(CH_2CH_2O)_{10}H$

Various photographic constitutional layers were applied on the support, thereby preparing a multilayer color photographic printing paper Sample (101) having layer composition shown below. Coating solutions were prepared as follows.

Preparation of the first layer coating solution 153.0 Grams of yellow coupler (ExY), 15.0 g of image-dye stabilizer (Cpd-1), 7.5 g of image-dye stabilizer (Cpd-2), and 16.0 g of image-dye stabilizer (Cpd-3) were dissolved in 25 g of solvent (Solv-1), 25 g of solvent (Solv-2), and 180 ml of ethyl acetate, and the resulting solution was dispersed and emulsified in 1,000 g of 10% aqueous gelatin solution containing 60 ml of 10% sodium dodecylbenzenesulfonate solution and 10 g of citric acid, thereby preparing emulsified dispersion A.

Separately, silver chlorobromide emulsion A (cubic grains, 3:7 (in silver molar ratio) blend of large size emulsion having 0.83 μm of average grain size and small size emulsion having 0.69 μm of average grain size, and 0.08 and 0.10 of deviation coefficient of grain size distribution, respectively, each in which emulsion 0.25 mol % of silver bromide was located at a part of the grain surface, wherein other silver halide was silver chloride) was prepared. Blue-sensitive sensitizing dyes A and B, shown below, were added in amounts of dyes that corresponds to $2.0\times10^{-4}$ mol and $2.5\times10^{-4}$ mol to the large size emulsion and small size emulsion, per mol of silver, respectively. The chemical sensitizing of this emulsion was carried out by adding sulfur sensitizing agent and gold sensitizing agent.

The above-described emulsified dispersion A and this silver chlorobromide emulsion A were mixed together and dissolved to give the composition shown below, thereby preparing the first layer coating solution.

Coating solutions for the second to seventh layers were also prepared in the same manner as the coating solution of first layer.

As a gelatin hardener for the respective layers, 1-oxy-3, 5-dichloro-s-triazine was used.

Further, Cpd-14 and Cpd-15 were added in each layer in such amounts that the respective total amount becomes 25.0 $mg/m^2$ and 50.0 $mg/m^2$.

In the silver chlorobromide emulsion of each photosensitive emulsion layer respective spectral sensitizing dyes shown below were used. Blue-sensitive emulsion layer:

Spectral-sensitizing dye A

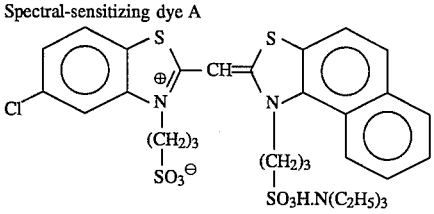

and

Spectral-sensitizing dye B

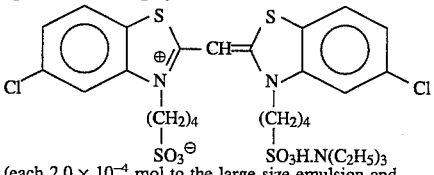

(each $2.0\times10^{-4}$ mol to the large size emulsion and $2.5\times10^{-4}$ mol to the small size emulsion, per mol of silver halide)

Green-sensitive emulsion layer:
Spectral-sensitizing dye C

-continued

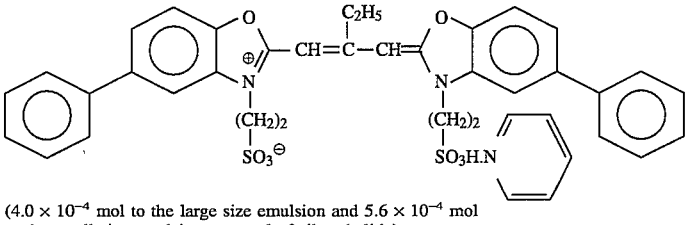

($4.0 \times 10^{-4}$ mol to the large size emulsion and $5.6 \times 10^{-4}$ mol to the small size emulsion, per mol of silver halide)

Spectral-sensitizing dye D

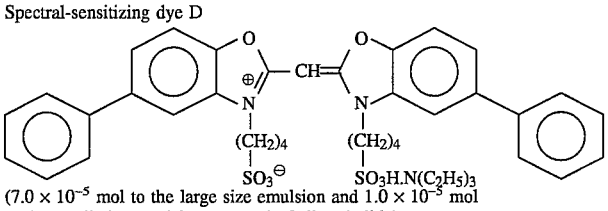

($7.0 \times 10^{-5}$ mol to the large size emulsion and $1.0 \times 10^{-5}$ mol to the small size emulsion, per mol of silver halide)

Red-sensitive emulsion layer
Spectral-sensitizing dye E

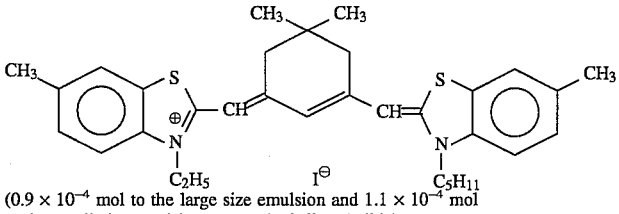

($0.9 \times 10^{-4}$ mol to the large size emulsion and $1.1 \times 10^{-4}$ mol to the small size emulsion, per mol of silver halide)

Further, the following compound was added in the red-sensitive layer in an amount of $2.6\times10^{-3}$ mol per mol of silver halide.

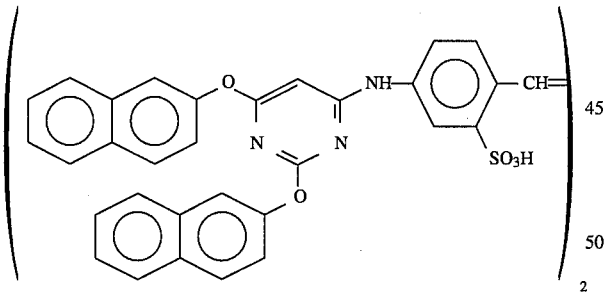

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

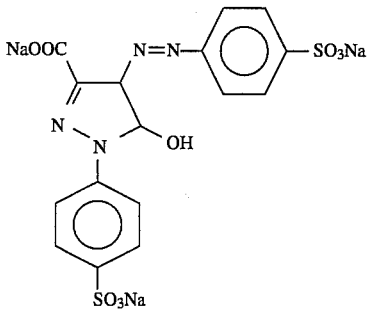

(10 mg/m²)

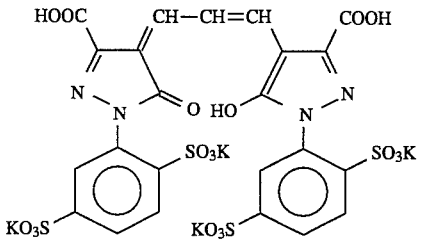

(10 mg/m²)

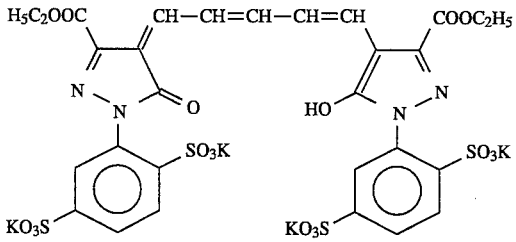

(40 mg/m²)

and

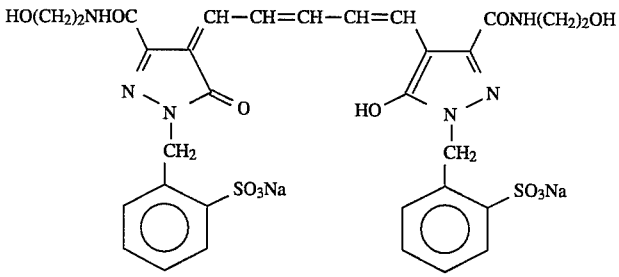

(20 mg/m²)

(Composition of Layers)

The composition of each layer is shown below. The figures represent coating amount (g/m2). The coating amount of each silver halide emulsion is given in terms of silver.

| | |
|---|---|
| Support | |
| Above-described polyester film or polyethylene-laminated paper | |
| First Layer (Blue-sensitive emulsion layer) | |
| Above-described silver chlorobromide emulsion A | 0.27 |
| Gelatin | 1.36 |
| Yellow coupler (ExY) | 0.67 |
| Image-dye stabilizer (Cpd-1) | 0.08 |
| Image-dye stabilizer (Cpd-2) | 0.04 |
| Image dye stabilizer (Cpd-3) | 0.08 |
| Solvent (Solv-1) | 0.12 |

-continued

| | |
|---|---|
| Solvent (Solv-2) | 0.12 |
| Second Layer (Color-mix preventing layer) | |
| Gelatin | 1.10 |
| Color-mix inhibitor (HQ-1) | 0.08 |
| Solvent (Solv-2) | 0.53 |
| Image-dye stabilizer (Cpd-7) | 0.03 |
| Third Layer (Green-sensitive emulsion layer) | |
| Silver chlorobromide emulsion B (cubic grains, mixture (1:3 in silver molar ratio) of large size emulsion B having average grain size of 0.49 μm and small size emulsion B having average grain size of 0.39 μm, whose deviation coefficients of grain size distribution were 0.10 and 0.08, respectively, in which each emulsion 0.9 mol % of silver bromide was located at a part of grain surface, wherein silver halide other than above silver bromide was silver chloride) | 0.13 |
| Gelatin | 1.45 |

-continued

| | |
|---|---|
| Magenta coupler (Exm) | 0.16 |
| Image-dye stabilizer (Cpd-5) | 0.15 |
| Image-dye stabilizer (Cpd-2) | 0.03 |
| Image-dye stabilizer (Cpd-6) | 0.02 |
| Image-dye stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color-mix preventing layer) | |
| Gelatin | 0.70 |
| Color-mix inhibitor (HQ-1) | 0.05 |
| Solvent (Solv-2) | 0.37 |
| Image-dye stabilizer (Cpd-7) | 0.02 |
| Fifth Layer (Red-sensitive emulsion layer) | |
| Silver chlorobromide emulsion C (cubic grains, mixture (1:4 in silver molar ratio) of large size emulsion C having average grain size of 0.55 μm and small size emulsion C having average grain size of 0.41 μm, whose deviation coefficients of grain size distribution were 0.09 and 0.11, respectively, in which each emulsion 0.7 mol % of silver bromide was located at a part of grain surface, wherein silver halide other than above silver bromide was silver chloride) | 0.20 |

-continued

| | |
|---|---|
| Gelatin | 0.90 |
| Cyan coupler (ExC) | 0.33 |
| Ultraviolet absorber (UV-2) | 0.18 |
| Image-dye stabilizer (Cpd-9) | 0.15 |
| Image-dye stabilizer (Cpd-10) | 0.15 |
| Image-dye stabilizer (Cpd-11) | 0.01 |
| Solvent (Solv-6) | 0.22 |
| Solvent (Solv-8) | 0.01 |
| Image-dye stabilizer (Cpd-6) | 0.01 |
| Solvent (Solv-1) | 0.01 |
| Image-dye stabilizer (Cpd-1) | 0.33 |
| Sixth Layer (Ultraviolet absorbing layer) | |
| Gelatin | 0.55 |
| Ultraviolet absorber (UV-1) | 0.38 |
| Image-dye stabilizer (Cpd-12) | 0.15 |
| Image-dye stabilizer (Cpd-5) | 0.02 |
| Seventh Layer (Protective layer) | |
| Gelatin | 1.33 |
| Acryl-modified copolymer of polyvinyl alcohol (modification degree: 17%) | 0.05 |
| Liquid paraffin | 0.02 |
| Image-dye stabilizer (Cpd-13) | 0.01 |

Compounds used were as follows:

(ExY) Yellow coupler

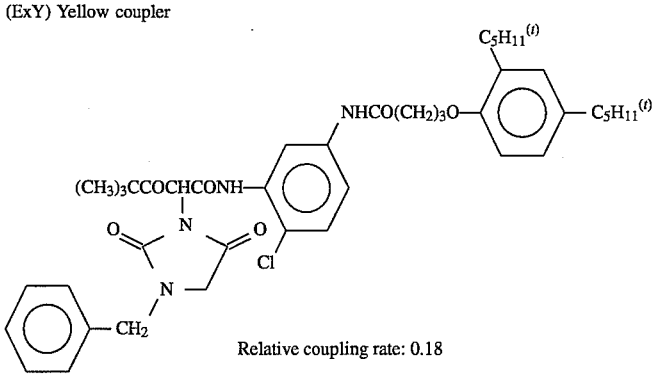

Relative coupling rate: 0.18

(ExM) Magenta coupler

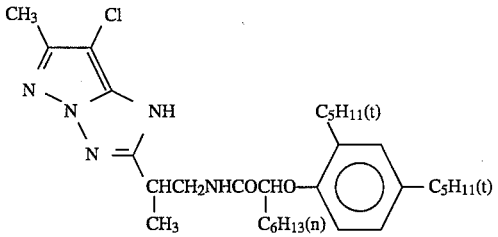

(ExC) Cyan coupler
Mixture (3:7 in molar ratio) of

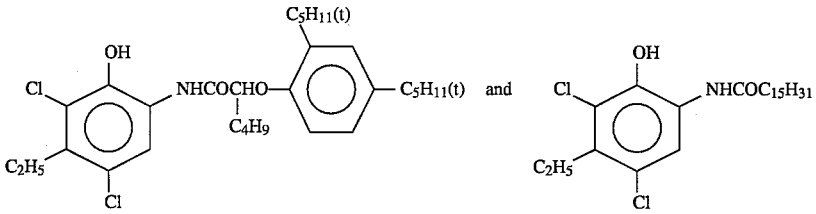

(Cpd-1) Image-dye stabilizer

-continued
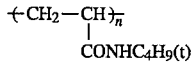
Av. molecular weight: 60,000
(Cpd-2) Image-dye stabilizer
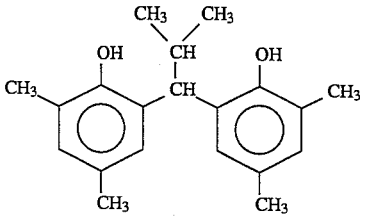
(Cpd-3) Image-dye stabilizer
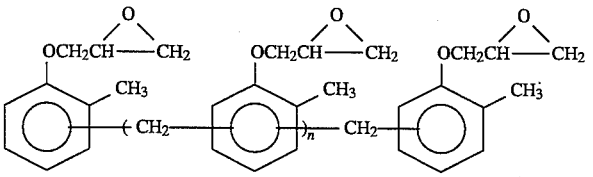
n = 7–8 (in average)
(Cpd-5) Image-dye stabilizer
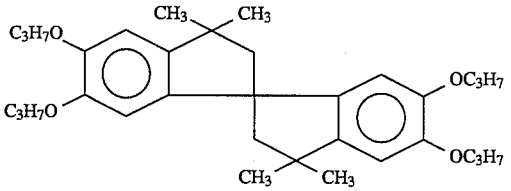
(Cpd-6) Image-dye stabilizer
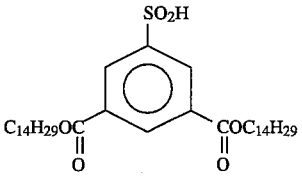
(Cpd-7) Image-dye stabilizer
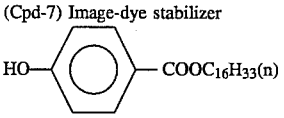
(Cpd-8) Image-dye stabilizer
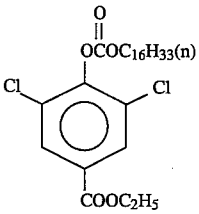
(Cpd-9) Image-dye stabilizer
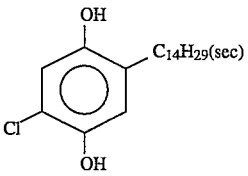
(Cpd-10) Image-dye stabilizer -continued
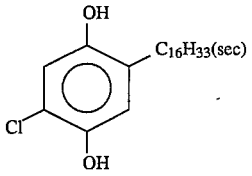
(Cpd-11) Image-dye stabilizer
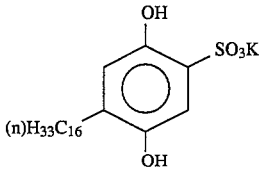
(Cpd-12) Image-dye stabilizer
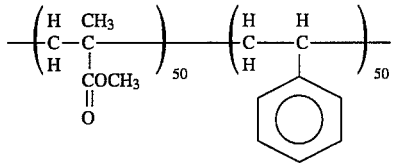
Av. molecular weight: 60,000
(Cpd-13) Image-dye stabilizer
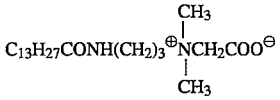
(Cpd-14) Antiseptic
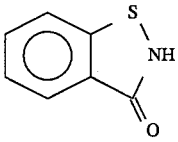
(Cpd-15) Antiseptic
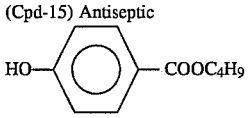
(UV-1) Ultraviolet ray absorber
Mixture of (1), (2), (3), and (4) (1:5:10:5) in weight ratio)
(1)
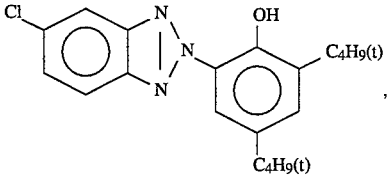
(2)
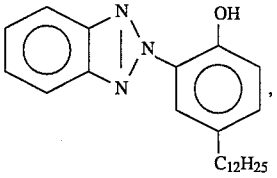
(3)
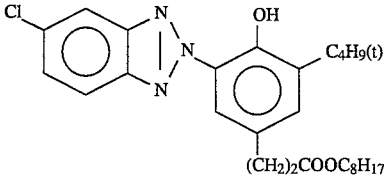
and
(4)
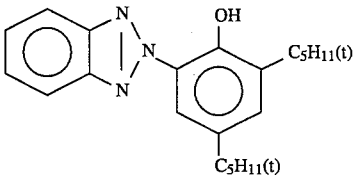
(UV-2) Ultraviolet ray absorber
Mixture of (5), (6), and (7) (1:2:2 in weight ratio)

-continued
(5)
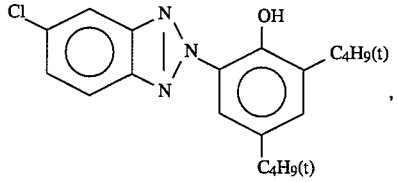
(6)
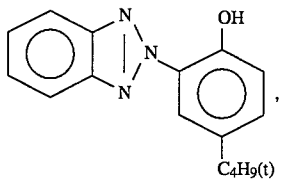
and (7)
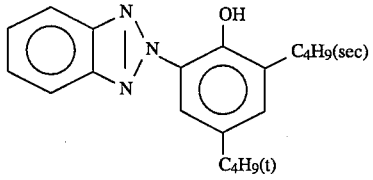
(Solv-1) Solvent
$C_8H_{17}CHCH(CH_2)_7COOC_8H_{17}$
$\quad\quad\quad Samples 102 to 127 were prepared in the same manner as Sample 101, except that support and compositions of the first layer, the second layer, and the fourth layer were changed as shown in Table 1.

To evaluate the sharpness, optical wedges were prepared so as to have a pattern with alternately repeated stripes of transparent parts (having a density of 0.05) and black parts (corresponding to the background part and having a density of 1.0) with a constant interval between them, and with each wedge having a different number of black line parts per 5 mm, but always a multiple of ten, varying from 10 to 100. Contact exposure was applied through these wedges in such a manner that the density of the background had neutral gray having a reflection density of 0.5 and the color development processing was carried out using a paper processor in the processing steps shown below.

Then, in order to evaluate the change of the color density due to a change in duration from the moment of exposure to light until the development processing, the same exposure to light for Sample "a", which was subjected to development processing 20 sec after exposure to light so that the reflection density might be 0.4, was applied; and 120 sec after exposure, the development processing was carried out to obtain Sample "b". The processing steps and the processing solutions were as follows:

| Processing step | Temperature | Time | Reple-nisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse | 30° C. | 90 sec | 350 ml | 10 liter |
| Drying | 70–80° C. | 60 sec | | |

Note: * Replenisher amount per $m^2$ of photographic material.

The composition of each processing solution was as follows, respectively:

| Color-developer | Tank Solution | Reple-nisher |
|---|---|---|
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfoneamidoesthyl)-3-methyl-4-aminoaniline sulfonate | 5.0 g | 7.0 g |
| N,N-bis(carboxymethyl)hydrazine | 4.0 g | 5.0 g |
| Fluorescent whitening agent (WHITEX 4B, made by Sumitomo Chemical Co.) | 1.0 g | 2.0 g |
| Water to make | 1000 ml | 1000 ml |
| pH (25° C.) | 10.05 | 10.45 |
| Bleach-fixing solution | | |
| (Both tank solution and replenisher) | | |
| Water | | 400 ml |
| Ammonium thiosulfate (700 g/l) | | 100 ml |
| Sodium sulfite | | 17 g |
| Iron (III) ammonium ethylenediaminetetraacetate | | 55 g |
| Disodium ethylenediaminetetraacetate | | 5 g |
| Ammonium bromide | | 40 g |
| Water to make | | 1000 ml |
| pH (25° C.) ammonium) | | 6.0 |
| Rinse solution | | |
| (Both tank solution and replenisher) | | |
| Ion-exchanged water (calcium and magnesium each are 3 ppm or below) | | |

In order to evaluate the sharpness, the above Samples processed for the evaluation of the sharpness were checked by 20 panelists, who counted the maximum number of visually distinguishable stripes of the pattern. The average of the numbers was designated as the representative value of the sharpness. Further, with respect to Samples 101 to 127 processed for evaluation of the sharpness, gloss on the surface of each Sample was evaluated by a visual evaluation and results are designated by o showing good in gloss and x showing bad in gloss.

Further, in order to evaluate the change in color density due to a change in duration from the moment of exposure to light until the development processing, the reflection density of the yellow of Sample "a" was subtracted from the reflection density of the yellow of Sample "b" to obtain a value.

Further, in order to evaluate the change in color density due to a change in duration from the moment of exposure to light until the development processing after storage in the form of a product, the Samples were stored for 2 weeks at 35° C., after which they were tested in the same way as above.

The results are shown in Table 2.

TABLE 1

| Sample No. | Water-resisting resin covered base paper | $TiO_2$ (wt %) | Yellow coupler in 1st layer | Color-mix inhibitor in 2nd and 4th layer |
|---|---|---|---|---|
| 101 | Polyethylene | 10 | ExY | HQ-1 (Comparison) |
| 102 | " | " | " | I-3 |
| 103 | " | " | YH-9 | I-3 |
| 104 | " | 20 | ExY | HQ-1 (Comparison) |
| 105 | " | " | " | I-3 |
| 106 | " | " | YH-9 | I-3 |
| 107 | Polyester (TA/IA* = 100/0) | 10 | ExY | HQ-1 (Comparison) |
| 108 | Polyester (TA/IA* = 100/0) | " | " | I-3 |
| 109 | Polyester (TA/IA* = 100/0) | " | YH-9 | I-3 |
| 110 | Polyester (TA/IA* = 100/0) | 20 | ExY | HQ-1 (Comparison) |
| 111 | Polyester (TA/IA* = 100/0) | " | " | I-3 |
| 112 | Polyester (TA/IA* = 100/0) | " | YH-9 | I-3 |
| 113 | Polyester (TA/IA* = 100/0) | 30 | ExY | HQ-1 (Comparison) |
| 114 | Polyester (TA/IA* = 100/0) | " | YH-9 | I-4 |
| 115 | Polyester (TA/IA* = 100/0) | " | " | I-3 |
| 116 | Polyester (TA/IA* = 100/0) | " | " | I-1 |
| 117 | Polyester (TA/IA* = 100/0) | " | " | I-9 |
| 118 | Polyester (TA/IA* = 100/0) | " | " | I-11 |
| 119 | Polyester (TA/IA* = 100/0) | " | " | I-22 |
| 120 | Polyester (TA/IA* = 100/0) | " | " | I-30 |

TABLE 1-continued

| Sample No. | Water-resisting resin covered base paper | $TiO_2$ (wt %) | Yellow coupler in 1st layer | Color-mix inhibitor in 2nd and 4th layer |
|---|---|---|---|---|
| 121 | Polyester (TA/IA* = 100/0) | " | YH-10 | I-3 |
| 122 | Polyester (TA/IA* = 100/0) | " | YH-11 | I-3 |
| 123 | Polyester | 40 | YH-9 | I-3 |
| 124 | Polyester (TA/IA = 90/10) | 30 | " | I-3 |
| 125 | Polyester (TA/IA = 50/50) | " | " | I-3 |
| 126 | Polyester (TA/NA** = 90/10) | " | " | I-3 |
| 127 | Polyester (TA/NA** = 90/10) | " | " | I-3 |

Note;
*TA/IA = Terephthalic acid/Isophthalic acid
**TA/NA = Terephthalic acid/Naphthalene-dicarboxylic acid,
wherein each mixing ratio of dicarboxylic acids is shown in a molar ratio.

TABLE 2

| Sample No. | Sharpness | Change of yellow density: Immediately after coating ("b" − "a") | Change of yellow density: After storage at 35° C., for two weeks ("b" − "a") | Surface gloss* | Remarks |
|---|---|---|---|---|---|
| 101 | 70.5 | −0.030 | −0.036 | x | Comparative example |
| 102 | " | −0.021 | −0.022 | x | Comparative example |
| 103 | " | −0.010 | −0.012 | x | Comparative example |
| 104 | 75.5 | −0.035 | −0.039 | x | Comparative example |
| 105 | " | −0.022 | −0.024 | x | Comparative example |
| 106 | " | −0.014 | −0.016 | x | Comparative example |
| 107 | 75.0 | −0.029 | −0.041 | ⊙ | Comparative example |
| 108 | " | −0.027 | −0.036 | ⊙ | Comparative example |
| 109 | " | −0.025 | −0.023 | ⊙ | This invention |
| 110 | 79.5 | −0.030 | −0.045 | ⊙ | Comparative example |
| 111 | " | −0.035 | −0.038 | ⊙ | This invention |
| 112 | " | −0.031 | −0.030 | ⊙ | This invention |
| 113 | 82.5 | −0.032 | −0.051 | ⊙ | Comparative example |
| 114 | " | −0.029 | −0.031 | ⊙ | This invention |
| 115 | " | −0.025 | −0.027 | ⊙ | This invention |
| 116 | " | −0.020 | −0.022 | ⊙ | This invention |
| 117 | " | −0.015 | −0.017 | ⊙ | This invention |
| 118 | " | −0.010 | −0.010 | ⊙ | This invention |
| 119 | " | −0.027 | −0.029 | ⊙ | This invention |
| 120 | " | −0.033 | −0.030 | ⊙ | This invention |
| 121 | " | −0.023 | −0.025 | ⊙ | This invention |
| 122 | " | −0.019 | −0.020 | ⊙ | This invention |
| 123 | 83.5 | −0.026 | −0.029 | ⊙ | This invention |
| 124 | 81.5 | −0.026 | −0.029 | ⊙ | This invention |
| 125 | 80.5 | −0.030 | −0.033 | ⊙ | This invention |
| 126 | 80.0 | −0.030 | −0.033 | ⊙ | This invention |
| 127 | 78.5 | −0.031 | −0.035 | ⊙ | This |

TABLE 2-continued

| Sample No. | Sharpness | Change of yellow density: Immediately after coating ("b" − "a") | Change of yellow density: After storage at 35° C., for two weeks ("b" − "a") | Surface gloss* | Remarks |
|---|---|---|---|---|---|
| | | | | | invention |

Note;
*⊙: good in surface gloss
x: bad in surface gloss

As is apparent from the results in Table 2, when the water-resistant resin is a polyethylene and the content of $TiO_2$ is 10 wt %, the change in color density due to a change in duration from the moment of exposure to light until the development processing is small, but the sharpness is unpreferably low (101 to 103). When the water-resistant resin is a polyethylene and the content of $TiO_2$ is 20 wt %, the change in color density is small and the sharpness is high, but unpreferably the smoothness is low and the surface gloss is poor (104 to 106). When the water-resistant resin is a polyester and a comparative color-mix inhibitor is used, the change in color density due to a change in duration from the moment of exposure to light until the development processing after the storage of the product is deteriorated, which is unpreferable (107 and 110). Even when a color-mix inhibitor of the present invention is used, if a yellow coupler whose relative coupling rate is low is used, the effect is not satisfactory (108 and 111). Thus, the constitution of the present invention can provide a color photography wherein the sharpness is high and the surface gloss is good, and can provide a photographic material wherein the change in color density due to a change in duration from the moment of exposure to light until the development processing is small.

Example 2

Photographic materials were prepared in the same manner as Example 1, except that compounds and their coating amounts were changed as shown below, and then the valuation according to the method in Example 1 was carried out, resulting obtaining the same results.

| | |
|---|---|
| Support | |
| Above-described polyester film or polyethylene-laminated paper | |
| First Layer (Blue-sensitive emulsion layer) | |
| Above-described silver chlorobromide emulsion A | 0.27 |
| Gelatin | 1.36 |
| Yellow coupler (ExY) | 0.67 |
| Image-dye stabilizer (Cpd-1) | 0.08 |
| Image-dye stabilizer (Cpd-2) | 0.04 |
| Image dye stabilizer (Cpd-3) | 0.08 |
| Solvent (Solv-1) | 0.12 |
| Solvent (Solv-2) | 0.12 |
| Second Layer (Color-mix preventing layer) | |
| Gelatin | 1.10 |
| Color-mix inhibitor (See below) | 0.08 |
| Ultraviolet absorber (UV-3) | 0.05 |

-continued

| | |
|---|---|
| Solvent (Solv-2) | 0.15 |
| Solvent (Solv-4) | 0.06 |
| Image-dye stabilizer (Cpd-7) | 0.03 |
| Solvent (Solv-9) | 0.03 |
| Third Layer (Green-sensitive emulsion layer) | |
| Silver chlorobromide emulsion B | 0.13 |
| Gelatin | 1.45 |
| Magenta coupler (ExM) | 0.26 |
| Image-dye stabilizer (Cpd-5) | 0.04 |
| Image-dye stabilizer (Cpd-2) | 0.02 |
| Image-dye stabilizer (Cpd-16) | 0.02 |
| Image-dye stabilizer (Cpd-8) | 0.03 |
| Solvent (Solv-7) | 0.50 |
| Fourth Layer (Color-mix preventing layer) | |
| Gelatin | 0.70 |
| Color-mix inhibitor (See below) | 0.05 |
| Ultraviolet absorber (UV-3) | 0.03 |
| Solvent (Solv-2) | 0.09 |
| Solvent (Solv-4) | 0.05 |
| Image-dye stabilizer (Cpd-7) | 0.02 |
| Solvent (Solv-9) | 0.02 |
| Fifth Layer (Red-sensitive emulsion layer) | |
| Silver chlorobromide emulsion C | 0.20 |
| Gelatin | 0.90 |
| Cyan coupler (ExC) | 0.33 |
| Ultraviolet absorber (UV-2) | 0.18 |
| Image-dye stabilizer (Cpd-9) | 0.15 |
| Image-dye stabilizer (Cpd-10) | 0.15 |
| Image-dye stabilizer (Cpd-11) | 0.01 |
| Solvent (Solv-6) | 0.22 |
| Image-dye stabilizer (Cpd-8) | 0.01 |
| Image-dye stabilizer (Cpd-6) | 0.01 |
| Solvent (Solv-1) | 0.01 |
| Image-dye stabilizer (Cpd-1) | 0.33 |
| Sixth Layer (Ultraviolet absorbing layer) | |
| Gelatin | 0.55 |
| Ultraviolet absorber (UV-1) | 0.38 |
| Image-dye stabilizer (Cpd-12) | 0.15 |
| Image-dye stabilizer (Cpd-5) | 0.02 |
| Seventh Layer (Protective layer) | |
| Gelatin | 1.33 |
| Acryl-modified copolymer of polyvinyl alcohol (modification degree: 17%) | 0.05 |
| Liquid paraffin | 0.02 |
| Image-dye stabilizer (Cpd-13) | 0.01 |

Compounds used herein are shown below. As a color-mix inhibitor in the second layer and the fourth layer, Compound I-1, I-3, I-4, I-9,I-11, I-22, or I-33 was used in the same manner as Example 1.

(Cpd-16) Image-dye stabilizer
Mixture (1:1 in molar ratio) of

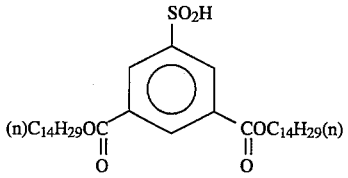

and

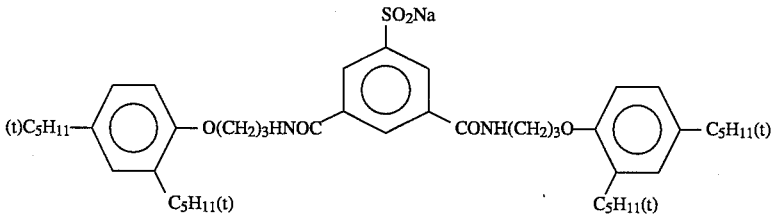

(Solv-7) Solvent
$O{=}P{+}O{-}C_6H_{13}(n))$ (Solv-8) Solvent

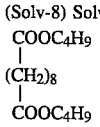

(Solv-9) Solvent

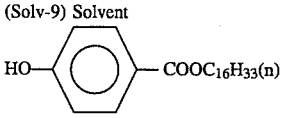

(UV-3) Ultraviolet absorber
Mixture (1:1 in molar ratio) of:

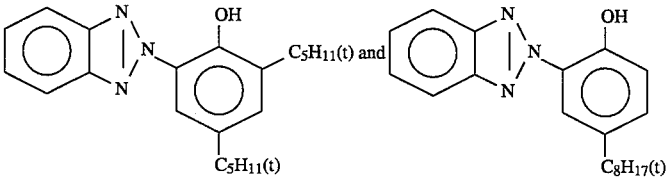

Example 3

The photographic materials prepared in Example 1 were exposed to light in the following manner and the change in density due to a change in duration from the amount of exposure to light until the development processing was measured. In the case of laser exposure for the present invention, the results showed that the improved effect of in the change in color density was high.

(Exposure to light)

The light sources used were a laser beam of wavelength 473 nm, which was taken out by wavelength conversion using an SHG crystal of $KNbO_3$ from YAG solid laser (oscillation wavelength: 946 nm), which used as an excitation light source a GaAlAs semiconductor laser (oscillation wavelength: 808.5 nm), a laser beam of wavelength 532 nm, which was taken out by wavelength conversion using an SHG crystal of KTP from $YVO_4$ solid laser (oscillation wavelength: 1064 nm), which used as an excitation light source GaAlAs semiconductor laser (oscillation wavelength: 808.7 nm), and a laser beam of AlGaInP (oscillation wavelength: about 670 nm; Type No. TOLD9211, manufactured by Toshiba Co.). The apparatus was constituted such that each laser beam was allowed, by a rotating polyhedron, to scan color paper that was moved vertically to the scanning direction, to carry out successive scanning exposure. Using this apparatus, the amount of light was varied and the relationship D/log E between the density (D) of the photographic material and the amount of light (E) was obtained. The amounts of the laser beams of three wavelengths were modulated using an external modulator, to control the amounts of the exposure to lights. This scanning exposure was carried out with 400 dpi, and the average exposure time per picture element was $5\times10^{-8}$ sec. In order to suppress the change of the amount of light of the semiconductor laser that would be caused by temperature, the temperature of the laser was kept constant by using a Peltier element.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material having a yellow-coupler-containing silver halide emulsion layer, a magenta-coupler-containing silver halide emulsion layer, and a cyan-coupler-containing silver halide emulsion layer, which respective layers are different in color sensitivity from each other, and non-photosensitive hydrophilic colloid layers, on a reflective support; which comprises (i) a reflective support prepared by laminating at least the surface to be emulsion-coated of a base support, which has been subjected to surface treatment by machine calendering, with a composition prepared by mixing and dispersing a white pigment into a water-resistant resin whose major component is a polyester obtained by polycondensation of a dicarboxylic acid and a diol, (ii) a silver halide emulsion of at least one emulsion layer comprising silver halide grains having a silver chloride content of 90 mol % or more, (iii) at least one non-photosensitive layer containing at least one color-mix inhibitor having a molecular weight of 350 or more, and (iv) a yellow coupler having a relative coupling rate of 0.20 or over;

wherein the base support is a paper support;

wherein the resin-containing composition is subjected to a surface treatment after being laminated on the base support, and then an undercoat layer is coated thereon.

2. The silver halide color photographic material as claimed in claim 1, wherein the polyester on the reflective support is a polyester whose major component is a polyethylene terephthalate.

3. The silver halide color photographic material as claimed in claim 1, wherein the dicarboxylic acid is selected from the group consisting of terephthalic acid, isophthalic acid, and naphthalenedicarboxylic acid.

4. The silver halide color photographic material as claimed in claim 1, wherein the reflective support is prepared by covering at least the surface to be emulsion-coated of the support with a resin composition obtained by mixing and dispersing a white pigment into a polyester synthesized by polycondensation of mixed dicarboxylic acids of terephthalic acid and isophthalic acid and a diol.

5. The silver halide color photographic material as claimed in claim 4, wherein the molar ratio of terephthalic acid and isophthalic acid is 9/1 to 2/8.

6. The silver halide color photographic material as claimed in claim 1, wherein the reflective support is prepared by covering at least the surface to be emulsion-coated of the support with a resin composition obtained by mixing and dispersing a white pigment into a polyester synthesized by polycondensation of mixed dicarboxylic acids of terephthalic acid and naphthalenedicarboxylic acid and a diol.

7. The silver halide color photographic material as claimed in claim 6, wherein the molar ratio of terephthalic acid and naphthalenedicarboxylic acid is 9/1 to 2/8.

8. The silver halide color photographic material as claimed in claim 1, wherein the diol component is selected from the group consisting of ethylene glycol, butylene glycol, neopentyl glycol, triethylene glycol, butanediol, hexylene glycol, an adduct of bisphenol A with ethylene oxide, and 1,4-dihydroxymethylcyclohexane.

9. The silver halide color photographic material as claimed in claim 8, wherein the diol component is ethylene glycol.

10. The silver halide color photographic material as claimed in claim 1, wherein the white pigment is selected from the group consisting of titanium oxide, barium sulfate, lithopone, aluminum oxide, calcium carbonate, silicon oxide, antimony trioxide, titanium phosphate, zinc oxide, white lead, zirconium oxide, a finely divided powder of a polystyrene and a finely divided power of a styrene/divinylbenzene copolymer.

11. The silver halide color photographic material as claimed in claim 1, wherein the mixing weight ratio of the white pigment to the water-resistant resist resin is from 5/95 to 70/30.

12. The silver halide color photographic material as claimed in claim 1, wherein the white pigment is titanium dioxide, and the weight ratio of the white pigment to the resin that is mixed with said white pigment, which resin's major component is a polyester, is from 5/95 to 70/30.

13. The silver halide color photographic material as claimed in claim 1, wherein the color-mix inhibitor having a molecular weight of 350 or more is represented by the following formula (I):

formula (I)

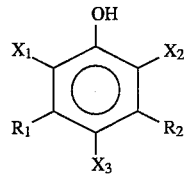

wherein $X_1$, $X_2$, $X_3$, $R_1$, and $R_2$ each represent a hydrogen atom or a substituent, and at least one of $X_1$, $X_2$, and $X_3$ represents a hydroxyl group or a sulfonamido group, provided that $X_1$, $X_2$, $X_3$, $R_1$, and $R_2$ are selected such that the molecular weight of the compound is 350 or more, the substituents in the ortho-positions relative to each other may bond together to form a ring, and any of $X_1$, $X_2$, $X_3$, $R_1$, and $R_2$ may be bonded to a polymer chain or may be bonded to a compound represented by formula (I) to form a dimer or a higher polymer.

14. The silver halide color photographic material as claimed in claim 1, wherein at least two intermediate layers, each arranged between silver halide emulsion layers, contain at least one color-mix inhibitor, and the total amount of the at least one color-mix inhibitor contained in the at least two intermediate layers is 0.05 to 0.5 g/m$^2$.

15. The silver halide color photographic material as claimed in claim 1, wherein the amount of yellow coupler is 0.002 to 0.5 mol per mol of the photosensitive silver halide in the same layer.

16. A method for forming a color image, which comprises exposing a color photographic material as claimed in claim 1 to light in a scanning exposure method with the exposure time being $10^{-4}$ sec or less per picture element, and then color-development processing said exposed color photographic material.

* * * * *